US007422063B2

(12) United States Patent
Crichlow

(10) Patent No.: US 7,422,063 B2
(45) Date of Patent: Sep. 9, 2008

(54) HYDROCARBON RECOVERY FROM SUBTERRANEAN FORMATIONS

(76) Inventor: Henry B Crichlow, 330 W. Gray St., Suite 504, Norman, OK (US) 73069

( * ) Notice: Subject to any disclaimer, the term of this patent is extended or adjusted under 35 U.S.C. 154(b) by 320 days.

(21) Appl. No.: 11/279,948

(22) Filed: Apr. 17, 2006

(65) Prior Publication Data

US 2007/0187103 A1 Aug. 16, 2007

Related U.S. Application Data

(60) Provisional application No. 60/772,515, filed on Feb. 13, 2006.

(51) Int. Cl.
*E21B 43/24* (2006.01)

(52) U.S. Cl. ..... 166/302; 166/60

(58) Field of Classification Search ..... 166/273
See application file for complete search history.

(56) References Cited

U.S. PATENT DOCUMENTS 4,265,310 A * 5/1981 Britton et al. ..... 166/259
4,753,293 A * 6/1988 Bohn ..... 166/267
7,225,879 B2 * 6/2007 Wylie et al. ..... 166/380

* cited by examiner

*Primary Examiner*—Frank S Tsay

(57) ABSTRACT

Recovery of viscous hydrocarbon by hot fluid injection into subterranean formations is assisted by using a specially designed and under-reamed vertical wellbore with multiple injection perforations separated from the production perforations by a moveable packer. In this oil recovery method the operator drills a typical vertical well, in which a cavity is developed below the pay zone by under-reaming the vertical wellbore to form a collection cavity. This under-reaming can be made up to several feet in diameter using standard reaming technology and tools. Steam is injected into the upper perforations and is prevented from bypassing the cold formation by a vertical hydraulic seal developed in an annular communication zone. Hot oil is produced into the lower perforations and is collected in the reamed out production cavity. A producing mechanism including pumping equipment lifts the produced oil from the central cavity to the surface.

36 Claims, 16 Drawing Sheets

HYDROCARBON RECOVERY FROM SUBTERRANEAN FORMATIONS

CROSS REFERENCE TO RELATED APPLICATIONS

This application claims priority from Disclosure Document 589,546 by Dr. Henry Crichlow filed on Nov. 7, 2005 and Provisional Patent 60/772,515 filed on Feb. 13, 2006 by Dr. Henry Crichlow.

INTRODUCTION

This invention relates generally to a new technology application and a new type of oil well system for recovery of hydrocarbons from subterranean heavy oil bearing formations including tar sands and oil shales.

This invention is related to prior filings by the same applicant, pertaining to the overall recovery of hydrocarbons from subterranean oil formations. The technology involves the novel use and application of equipment and techniques in which a combination of vertical and horizontal wells are drilled from the surface down to an oil bearing formation. In addition, this invention utilizes a collection cavity drilled below the vertical wellbore by under-reaming to form a collection site for the produced oil. In addition, a vertical communication zone is first developed in the annular region between the top injection perforations and the lower producing formation by a removable high temperature wellbore heater or by the under-reaming of a portion of the vertical wellbore. A packer separates the injection zone from the production zone such that displaced oil flow occurs in the annular communication zone region from top to bottom.

The technology is a new application using some elements of an existing drilling, completion and production technology, which have hitherto been used in conventional oil well drilling. A novel completion technique uses injection and production perforations separated by a wellbore packer and the use of a vertical communication zone.

FIELD OF INVENTION

THIS INVENTION is a new approach for oil recovery in heavy oil systems using injected hot fluid, in one embodiment, steam, a vertical annular hot communication zone and a downhole collection cavity under-reamed in the vertical wellbore. The invention is particularly suited to making heavy oil formations, oil shales and tar sands producible by a single wellbore drilled into and through the hydrocarbon pay zone. The invention however is not limited to recovery of heavy oils only; it can be used for many oil recovery processes such as tar sands and oil shale.

With this invention, the operator drills a new type of well, completes it, as indicated herein and produces the oil during the oil displacement process.

BACKGROUND OF THE INVENTION

Introduction

Heavy hydrocarbons in the form of petroleum deposits are distributed worldwide and the heavy oil reserves are measured in the hundreds of billions of recoverable barrels. Because of the relatively high viscosity, these crude deposits are essentially immobile and cannot be easily recovered by conventional primary and secondary means. The only economically viable means of oil recovery is by the addition of heat to the oil deposit, which significantly decreases the viscosity of the oil and allows the oil to flow from the formation into the producing wellbore. Today, the steam injection can be done in a continuous fashion in which steam displaces oil from hot zones to the producer wells or intermittently as in the so-called "huff and puff" or cyclic steam process in which the steam is injected into, and oil produced from the same well after a predetermined soaking period. Oil recovery by steam injection involves a combination of physical processes including, gravity drainage, steam drive and steam drag to move the heated oil from the upper oil zone into the lower producing zone.

The most significant oil recovery problem with heavy oil, tar sands and similar hydrocarbonaceous material is the extremely high viscosity of the native hydrocarbons. At reservoir conditions, the oil viscosity ranges from 10,000 cp at the low end of the range to 5,000,000 cp at the high end. The viscosity of steam at injection conditions is about 0.020 cp. Assuming similar rock permeability to both phases steam and oil, then the viscosity ratio provides a good measure of the flow transmissibility of the formation to each phase. Under the same pressure gradient, gaseous steam can therefore flow from 500,000 to 250,000,000 times easier through the material than the oil at reservoir conditions. Because of this viscosity ratio, it is imperative and critical to any recovery application that the steam be confined or limited to an area of the reservoir by a seal. This seal can be physical, hydraulic or pneumatic and essentially must provide a physical situation which guarantees no-flow of any fluid across an interface. This can be implemented by several means. Without this "barrier" the steam will bypass, overrun, circumvent, detour around the cold viscous formation and move to the producer wellbore. This invention addresses and resolves this major obstructive element in heavy oil recovery.

Because of the extremely high viscosity of the heavy hydrocarbon in-situ, it is difficult if not impossible to physically move the displaced oil from the hot mobile location, through the cold porous rock formation to the producing wellbores. By implementing the novel processes which are taught in this application by this invention, especially the development of a hot annular vertical communicative zone of reduced viscosity and increased transmissibility, the oilfield operator can see improved performance, lower costs, better oilfield management, and allow for efficient and orderly development of petroleum resources.

In one embodiment of the invention, improvements have been made in enhancing the contact of the steam with the native heavy oil by the introduction of horizontal well technology, which allows greater recovery than with the customary vertical wells. This current invention provides a further extension of the horizontal technology in which a novel drilling methodology is applied to the drilling effort to allow wells of much larger lateral extent, potentially larger diameters and thereby more efficient recovery systems.

THIS NEW INVENTION provides an improvement in the oil recovery method whereby the operator drills a typical vertical well which is drilled from the surface down to the producing formation and continues past the pay zone into the under-burden. A cavity is developed below the pay zone by under-reaming the vertical wellbore to form a collection cavity. This under-reaming can be made up to 8 or 9 feet in diameter using standard reaming technology and tools used in the oil and gas industry today. The volumetric size of the cavity will be sized according to the required and expected oil production from each well.

This cavity is an additional implementation into which the hot displaced oil is allowed to drain from the heated zones into this collection cavity. Standard pumping equipment lifts the produced oil from the collection cavity. The techniques proposed herein uses a combination of drilling activities that are known separately and distinctly in the industry, but have not yet been utilized in this integrated manner shown in this new invention.

Prior Art

Various methods and processes have been disclosed for recovery of oil and gas by using horizontal wells. There have been various approaches utilized with vertical wellbores, to heat the reservoirs by injection of fluids and also to create a combustion front in the reservoir to displace the insitu oil from the injection wellbore to the production wellbore.

U.S. Pat. No. 3,986,557 claims a method using a horizontal well with two wellheads that can inject steam into a tar sand formation mobilizing the tar in the sands. In this patent, during the injection of the steam it is hoped that the steam will enter the formation and not continue directly down the open wellbore and back to the surface of the opposite wellhead. It is technically difficult to visualize the steam entering a cold formation with extremely highly viscous oil, while a completely open wellbore is available for fluid flow away from the formation. Furthermore, U.S. Pat. No. 3,986,557 teaches that the steam is simultaneously injected through perforations into the cold bitumen formation while hot oil is flowing in the opposite direction against the invading high pressure steam through the same perforations through the rock pore structure. This situation is not only physically impossible but it thermodynamically impossible for the fluid to flow against the pressure gradient.

U.S. Pat. No. 3,994,341 teaches a vertical closed loop system inside the wellbore tubulars in which a vertical wellbore is used to generate a vertical circulation of hot fluids which heat the wellbore and nearby formation. Hot fluids and drive fluids are injected into upper perforations which allow the driven oil to be produced from the bottom of the formation after being driven towards the bottom by the drive fluid.

U.S. Pat. No. 4,034,812 describes a cyclic injection process where a single wellbore is drilled into an unconsolidated mineral formation and steam is injected into the formation for a period of time to heat the viscous petroleum near the well. This causes the unconsolidated mineral sand grains to settle to the bottom of the heated zone in a cavity and the oil to move to the top of the zone.

U.S. Pat. No. 4,037,658 teaches the use of two vertical wells connected by a cased horizontal shaft or "hole" with a flange in the vertical well. This type of downhole flange connection is extremely difficult if not impossible to implement in current oilfield practice. Two types of fluids are used in this patent, one inside the horizontal shaft as a heater fluid and one in the formation as a drive fluid. Both fluids are injected either intermittently or simultaneously from the surface wellheads.

Butler et al in U.S. Pat. No. 4,116,275 use a single horizontal wellbore with multiple tubular strings internal to the largest wellbore for steam recovery of oil. Steam was injected via the annulus and after a soak period, the oil is produced from the inner tubing strings.

U.S. Pat. No. 4,445,574 teaches the drilling of a single well with two wellheads. This well is perforated in the horizontal section and a working fluid is injected into the wellbore to produce a mixture of reservoir oil and injected working fluid. Similar to the U.S. Pat. No. 3,986,557 patent it is difficult from a hydraulic point of view to visualize and contemplate the working fluid entering the formation in a vertical direction while an open wellbore is available for fluid flow horizontally and vertically out the distal end of this wellbore.

U.S. Pat. No. 4,532,986 teaches an extremely complex dual well system including a horizontal wellbore and a connecting vertical wellbore which is drilled to intersect the horizontal well. The vertical well contains a massively complex moveable diverter system with cables and pulleys attached to the two separate wellheads to allow the injection of steam. This system is used to inject steam from the vertical wellhead into the horizontal wellbore cyclically and sequentially while the oil is produced from the wellhead at the surface end of the horizontal well.

Huang in U.S. Pat. No. 4,700,779 describes a plurality of parallel horizontal wells used in steam recovery in which steam is injected into the odd numbered wells and oil is produced in the even numbered wells. Fluid displacement in the reservoir occurs in a planar fashion.

U.S. Pat. No. 5,167,280 teaches single concentric horizontal wellbores in the hydrocarbon formation into which a diffusible solvent is injected from the distal end to effect production of lowered viscosity oil backwards at the distal end of the concentric wellbore annulus.

U.S. Pat. No. 5,215,149 Lu, uses a single wellbore with concentric injection and production tubular strings in which the injection is performed through the annulus and production occurs in the inner tubular string, which is separated by a packer. This packer limits the movement of the injected fluids laterally along the axis of the wellbores. In this invention, the perforations are made only on the top portion of the annular region of the horizontal well. Similarly, the production zone beyond the packer is made on the upper surface only of the annular region. These perforated zones are fixed at the time of well completion and remain the same throughout the life of the oil recovery process.

Balton in U.S. Pat. No. 5,402,851 teaches a method wherein multiple horizontal wells are drilled to intersect or terminate in close proximity a vertical well bore. The vertical wellbore is used to actually produce the reservoir fluids. The horizontal wellbore provides the conduits, which direct the fluids to the vertical producing wellbore.

U.S. Pat. No. 5,626,193 by Nzekwu et al disclose a single horizontal well with multiple tubing elements inside the major wellbore. This horizontal well is used to provide gravity drainage in a steam assisted heavy oil recovery process. This invention allows a central injector tube to inject steam and then the heated produced fluids are produced backwards through the annular region of the same wellbore beginning at the farthest or distal end of the horizontal wellbore. The oil is then lifted by a pump. This invention shows a process where the input and output elements are the same single wellbore at the surface.

U.S. Pat. No. 5,655,605 attempts to use two wellbores sequentially drilled from the surface some distance apart and then to have these horizontal wellbore segments intersect each other to form a continuous wellbore with two surface wellheads. This technology while theoretically possible is operationally difficult to hit such a small underground target, i.e the axial cross-section of a typical 8-inch wellbore using a horizontal penetrating drill bit. It further teaches the use of the horizontal section of these intersecting wellbores to collect oil produced from the formation through which the horizontal section penetrates. Oil production from the native formation is driven by an induced pressure drop in the collection zone by a set of valves or a pumping system which is designed into the internal concentric tubing of this invention. The U.S. Pat. No. 5,655,605 also describes a heating mechanism to lower the viscosity of the produced oil inside the collection horizontal section by circulating steam or other fluid through an additional central tubing located inside the horizontal section. At no time does the steam or other hot fluid actually contact the oil formation where viscosity lowering by sensible and latent heat transfer is needed to allow oil production to occur.

Patent application 20050045325 describes a recovery mechanism for heavy oil hydrocarbons in which a pair of wells is used. A vertical injector well is horizontally separated from a vertical production well. The hot fluid, steam or air is injected into the bottom portion of the injector and is expected to displace the very viscous immobile oil from the cold reservoir and push this hot oil through the cold oil saturated formation eventually to the producer. The invention expects oil flow to occur by drilling a web or radial channels from the injector to the producer. It is inconceivable that viscous cold oil, or even lower viscosity hot oil will preferably flow along these channels while extremely low viscosity high-pressure steam will flow through the cold formation. Flow in porous media dictates that hot, saturated steam will completely bypass cold viscous oil and the process will be a quick steam recycle process from injector to producer.

U.S. Pat. No. 6,708,764 provides a description of an undulating well bore. The undulating well bore includes at least one inclining portion drilled through the subterranean zone at an inclination sloping toward an upper boundary of the single layer of subterranean deposits and at least one declining portion drilled through the subterranean zone at a declination sloping toward a lower boundary of the single layer of subterranean deposits. This embodiment looks like a waveform situated in the rock formation.

U.S. Pat. No. 6,725,922 utilizes a plurality of horizontal wells to drain a formation in which a second set of horizontal wells are drilled from and connected to the first group of horizontal wells. These wells from a dendritic pattern arrangement to drain the oil formation.

U.S. Pat. No. 6,729,394 proposes a method of producing from a subterranean formation through a network of separate wellbores located within the formation in which one or more of these wells is a horizontal wellbore, however not intersecting the other well but in fluid contact through the reservoir formation with the other well or wells.

U.S. Pat. No. 6,948,563 illustrates that increases in permeability may result from a reduction of mass of the heated portion due to vaporization of water, removal of hydrocarbons, and/or creation of fractures. In this manner, fluids may more easily flow through the heated portion U.S. Pat. Nos. 6,951,247, 6,929,067, 6,923,257, 6,918,443, 6,932,155, 6,929,067, 6,902,004, 6,880,633, 20050051327, 20040211569 by various inventors and assigned to Shell Oil Company have provided a very exhaustive analysis of the oil shale recovery process using a plurality of downhole heaters in various configurations. These patents utilize a massive heat source to process and pyrolize the oil shale insitu and then to produce the oil shale products by a myriad of wellbore configurations. These patents teach a variety of combustors with different geometric shapes one of which is a horizontal combustor system which has two entry points on the surface of the ground, however the hydrocarbon production mechanism is considerably different from those proposed herein by this subject invention.

U.S. Pat. No. 6,953,087 by Shell, shows that heating of the hydrocarbon formation increases rock permeability and porosity. This heating also decreases water saturation by vaporizing the interstitial water. The combination of these changes increases the fluid transmissibility of the formation rock in the heated region.

The Society of Petroleum Engineers Ref. 1, SPE paper 20017 teaches a computer simulation of a displacement process using a concentric wellbore system of three wellbore elements and complex packers in which steam is injected in a vertical wellbore similar to that in the U.S. Pat. No. 3,994,341. Simulated steam injection occurs through one tubing string and circulates in the wellbore from just above the bottom packer to the injection perforations near the top of the tar sand. This perforations near the top of the tar sand. This circulating steam turns the wellbore into a hot pipe which heats an annulus of tar sand and provides communication between the steam injection perforations near the top of the tar sand and the fluid production perforations near the bottom of the tar sand. This process requires 7 years to increase oil production from 20 BOPD to 70 BOPD.

Paper 37115 describes a single-well technology applied in the oil industry which uses a dual stream well with tubing and annulus: steam is injected into the tubing and fluid is produced from the annulus. The tubing is insulated to reduce heat losses to the annulus. This technology tries to increase the quality of steam discharged to the annulus, while avoiding high temperatures and liquid flashing at the heel of the wellbore.

SPE paper 50429 presents an experimental horizontal well where the horizontal well technology was used to replace ten vertical injection wells with a single horizontal well with limited entry. The limited-entry perforations enabled steam to be targeted at the cold regions of the reservoir.

SPE paper 50941 presents the "Vapex" process which involves injection of vaporized hydrocarbon solvents into heavy oil and bitumen reservoirs; the solvent-diluted oil drains by gravity to a separate and different horizontal production well or another vertical well.

SPE paper 53687 shows the production results during the first year of a thermal stimulation using dual and parallel horizontal wells using the SAGD technology in Venezuela.

SPE paper 75137 describes a THAI—'Toe-to-Heel Air Injection' system involving a short-distance displacement process, that tries to achieve high recovery efficiency by virtue of its stable operation and ability to produce mobilized oil directly into an active section of the horizontal producer well, just ahead of the combustion front. Air is injected via a separate vertical or a separate horizontal wellbore into the formation at the toe end of different horizontal producer well and the combustion front moves along the axis of the producer well.

SPE paper 78131 published an engineering analysis of thermal simulation of wellbore in oil fields in western Canada and California, U.S.A.

SPE paper 92685 describes U-tube well technology in which two separate wellbores are drilled and then connected to form a single wellbore. The U-tube system was demonstrated as a means of circumventing hostile surface conditions by drilling under these physical obstacles.

Reference 2 shows conclusively that the gravity drainage effect is the most critical factor in oil recovery in heavy oil systems undergoing displacement by steam.

Very few of these prior art systems have been used in the industry with any success because of their technical complexity, operational difficulties, and being physically impossible to implement or being extremely uneconomical systems.

For example, in U.S. Pat. No. 3,994,341, this embodiment which although on the surface resembles the invention herein differs significantly since, the U.S. Pat. No. 3,994,341 forms a vertical passage way only by circulating a hot fluid in the wellbore tubulars to heat the nearby formation, the U.S. Pat. No. 3,994,341 patent claims the drive fluid promotes the flow of the oil by vertical displacement downwards to the producing perforations at the bottom, the U.S. Pat. No. 3,994,341 teaches the production perforations are set at the bottom of the vertical formation, a distance which can be several hundred feet. In this U.S. Pat. No. 3,994,341 embodiment, since no control mechanism like a back pressure system or pressure control system is taught, it is obvious that the high pressure drive steam, usually at several hundred psi, will preferentially flow down the vertical passageway immediately on injection and bypass the cold formation with its highly viscous crude and extremely low transmissibility. Secondly, the large distance between the top of the formation and the bottom of the formation will cause condensation of the drive steam allowing essentially hot water to be produced at the bottom with low quality steam, both fluids being re-circulated back to the surface. In addition, the mechanism to heat the near wellbore can only be based on conductive heat transfer through the steel casing. There is ineffective heat transfer since there is no direct steam contact with the formation rock in which latent heat transfer to formation fluids and rock can occur, this latent heat being the major heat transport system. The U.S. Pat. No. 3,994,341 process is incapable of delivering sufficient heat in a reasonable time to heat the formation sufficiently to lower the viscosity of the oil, raise the porosity and permeability of the formation as taught in the present patent application.

There is a long felt need in the industry for a means of moving the heated low viscosity crude oil that has been contacted by the steam in the steam zone to a place or location where it can be produced without having to move it through a cold heavily viscous oil saturated formation. This problem has continued to baffle the contemporary and prior art with possibly the only exception being the SAGD patent which uses two horizontal wells closely juxtaposed in a vertical plane. Even this SAGD approach has inherent difficulties in initiating the hot oil flow between the two wellbores. Trying to push the hot oil through a cold formation is an intractable proposition. The subject invention offers a solution to this need and provides the mechanism by which the solution can be implemented using conventional equipment and procedures.

Shortcomings of prior art can be related a combination of effects. These include;

(1) the inability of the process to inject the hot fluid into cold highly viscous oil saturated formations having a limited conductivity where the hydrocarbon viscosities are in excess of $10^6$ cp. With this viscosity the liquid is essentially immobile at reservoir temperature.

(2) the inability to overcome the viscosity difference effect, wherein the viscosity of steam is less than 0.020 cp under the reservoir conditions which makes the flow of steam through porous media 5,000,000 times easier than cold oil having a high viscosity of 100,000 cp. This flow ratio is based directly on the viscosity ratios of 100,000/.02;

(3) the inability of the prior methods to prevent bypass of injected fluid directly from the injector source towards the producing sink;

(4) the inability of the prior methods to form and maintain a viable communication zone from the steam zone or chamber to the producing sink while simultaneously preventing bypass and early breakthrough of steam;

(5) the inability of the prior processes to effectively utilize the gravity drainage effects created by the low density of the hot steam compared to the high density of condensed water and hot oil;

(6) the inability of the prior processes to heat the formation effectively by physical contact between the steam and the rock formation such that latent heat, the major source of steam heat energy, can be transferred to the rock and hydrocarbons efficiently;

(7) The requirement of long lead times of months to years of hot fluid injection, before there is any measurable production response of the displaced oil in the production wells;

(8) The inability of the existing technology to maintain and sustain oil production rates when applied to large patterns of several wells;

(9) Finally the use of overly complex equipment of questionable operational effectiveness to implement the process in the field.

SUMMARY OF THE INVENTION

THIS NEW INVENTION provides an improvement in heavy oil recovery whereby the operator drills a specially designed vertical well. A segment of this well is enlarged to form a production cavity, a plurality of lateral wells is drilled into the producing formation from the vertical wellbore by cutting a window in the vertical wellbore casing and drilling out laterally. An additional implementation is the development of a collection cavity in the vertical wellbore, into which the hot displaced oil is allowed to drain from the lateral horizontal wells in to this collection cavity. A producing mechanism including pumping equipment lifts the produced oil from the central cavity to the surface. The techniques proposed herein use a combination of drilling activities that are known separately and distinctly in the industry, but have not yet been utilized in this integrated manner shown in this new invention.

In this oil recovery method the operator drills a vertical well which is drilled from the surface down to the producing formation and continues past the pay zone into the underburden. A cavity is developed below the pay zone by under-reaming the vertical wellbore to form a collection cavity. This under-reaming can be made up to 8 or 9 feet in diameter using standard reaming technology and tools used in the oil and gas industry today as shown in Ref. 3. The volumetric size of the cavity will be sized according to the required and expected oil production from each well.

The hot displaced oil is allowed to drain from the heated zones into this collection cavity. Standard pumping equipment lifts the produced oil from the collection cavity.

An object of this invention is to provide an improved process for recovery of heavy oils and similar hydrocarbons from subterranean formations. The use of a single well bore, with an isolation packer vertically separating injection and production perforations, along with a collection cavity connected to a producer well system. In one embodiment, the communication between the injection zone and production zone is made possible by the initial heating via downhole internal wellbore heater of the near wellbore annulus, to a high enough temperature such that the in-situ heavy oil is lowered in viscosity. The heated zone then becomes an annular communication zone for the fluids from the injection zone to move under gravity and hydraulic pressure to the lower production perforations. Bypassing of injected steam is prevented by the U-Tube effect of the produced fluid in the cavity and production tubing along with an optional downhole pressure regulator if required.

An object of this invention is to provide an improved process for recovery of heavy oils and other highly viscous hydrocarbons from subterranean formations by exploiting the advantages provided by gravity drainage effect in the displacement process of heated viscous oils in porous formations using the steam driven displacement mechanisms. The use of a modified single well bore with a collection cavity connected to a producer well system, has several engineering benefits including cost reduction, better fluid displacement and more engineering control and accelerated economic recovery of the injection and oil recovery process.

Another specific objective is to provide a means whereby the same wellbore perforations along the vertical section of the wellbore can be used sequentially for either injection or production as required by the operator.

Another specific objective is to use the movable packer between the injection and production perforations, which forces the steam to exit the wellbore and enter the oil zone at a preset location upstream of the production perforations.

Another specific objective is after the initial oil region is depleted, to unseat and move the movable packer between the injection and production perforations a preset distance along the axis of the wellbore and reseat it to allow the steam displacement process to continue throughout the reservoir in a new undepleted or virgin oil zone.

Another specific objective is to provide a concentric annular communication channel in the formation, which allows the heated oil to move from the upper steam zone to the production perforations in the lower production zone.

Another specific objective is to provide a means to considerably reduce the distance the heated oil has to move through the producing formations from the steam injection point to be produced in the wellbore.

Another specific objective is to provide a means whereby oil production begins as early as possible during the injection process compared to existing technologies like Steam Assisted Gravity Drainage (SAGD) and conventional Thermal Enhanced Oil Recovery (TEOR), where oil production takes place after a considerable length of steam injection ranging from several weeks to several months.

Another specific objective is to allow the steam to replace oil and to pressure up the steam bank at the top, which helps to displace low viscosity, heated oil downwards along the interface of steam/cold reservoir oil to the producing perforations where there exists a localized pressure sink because oil is being removed during production.

Another specific objective is to use the accumulated oil in the wellbore to act as a hydraulic seal, allowing the steam to remain uppermost in the injector zone of the wellbore and thereby maximize growth of the steam zone in the reservoir where it is more effective.

Another specific objective is to use the produced oil, which accumulates in the production zone of the wellbore to act as a backpressure system such that the steam bank is prevented from vertical breakthrough by flowing down the wellbore.

Another specific objective is to control surface production rates thereby allowing the reservoir pressure to be maintained at a level such that no steam is produced because of the back pressure in the production wellbore keeping the steam isolated in the steam bank.

BRIEF DESCRIPTION OF THE DRAWINGS

The present invention consists of the wellbore and associated components shown in the figures below.

LIST OF ELEMENTS

Figure 1:
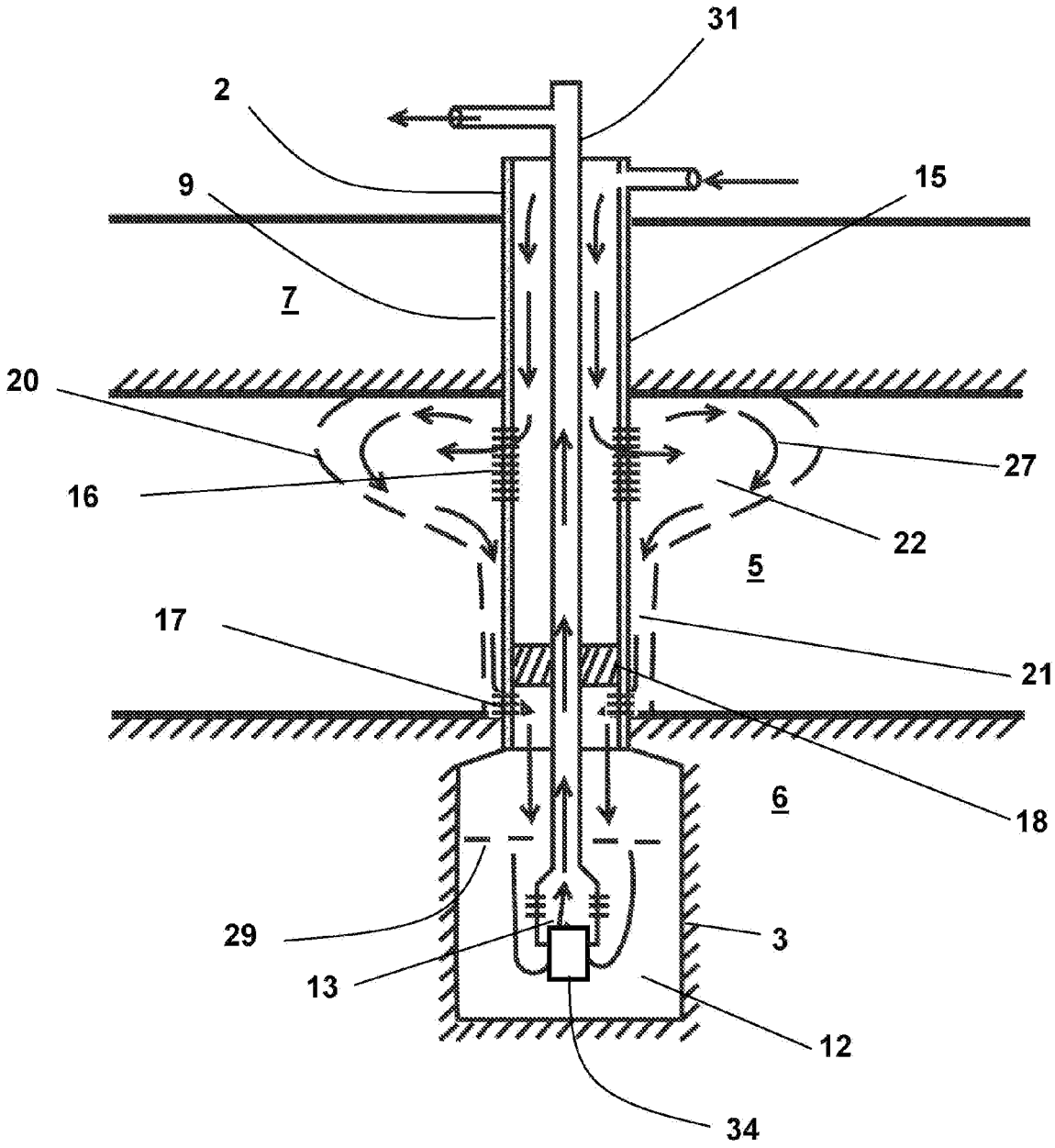
FIG. 1 Shows a cross-section of the vertical wellbore, the pay zone, perforation zones, the steam chamber, the isolation packer, the wellbore cavity and the downhole equipment.

No Description
1 Surface of ground
2 Central producer wellbore
3 Cavity below central wellbore
4 Lateral Wellbore for Injecting Steam
5 Hydrocarbon bearing formation
6 Underburden Formations
7 Overburden formations
8 Entry wellhead
9 Downward section of wellbore
10 Injection Displacement Zone
11 High transmissibility heated annular zone

12 Hot oil
13 Downhole Pump
14 Window cut in the Casing for lateral wellbore drilling
15 Well Casing
16 Well Perforations for fluid injection
17 Well Perforations for oil and water production
18 Wellbore movable packer
19 Wellbore movable downhole heater
20 Steam bank or steam chamber
21 Fluid Communication Zone
22 Steam
23 Liquid Seal by hot fluid
24 Accumulation Zone
25 Unswept formation zone
26 Annular reamed zone
27 Oil flow direction
28 Successive zones of steam growth
29 Horizontal Fluid seal level in communication zones and wellbores
30 Wellbore liner
31 Production tubing
32 Power Cable to Heater
33 Axis (end) view of horizontal (lateral) wellbore
34 Backpressure device
35 Steam injection time.
36 Steam soak time
37 Oil Production rate decline curve
38*a* Oil Production cycle embedded in the steam injection cycle.
38*b* Oil Daily production rate
38*c* Well Shut-in period, zero production rate
39 Wellbore heating period.
40 Oil flow rate increase trend
41 Oil flow rate decreasing trend.

DETAILED DESCRIPTION OF THE PROPOSED INVENTION

Figure 10:
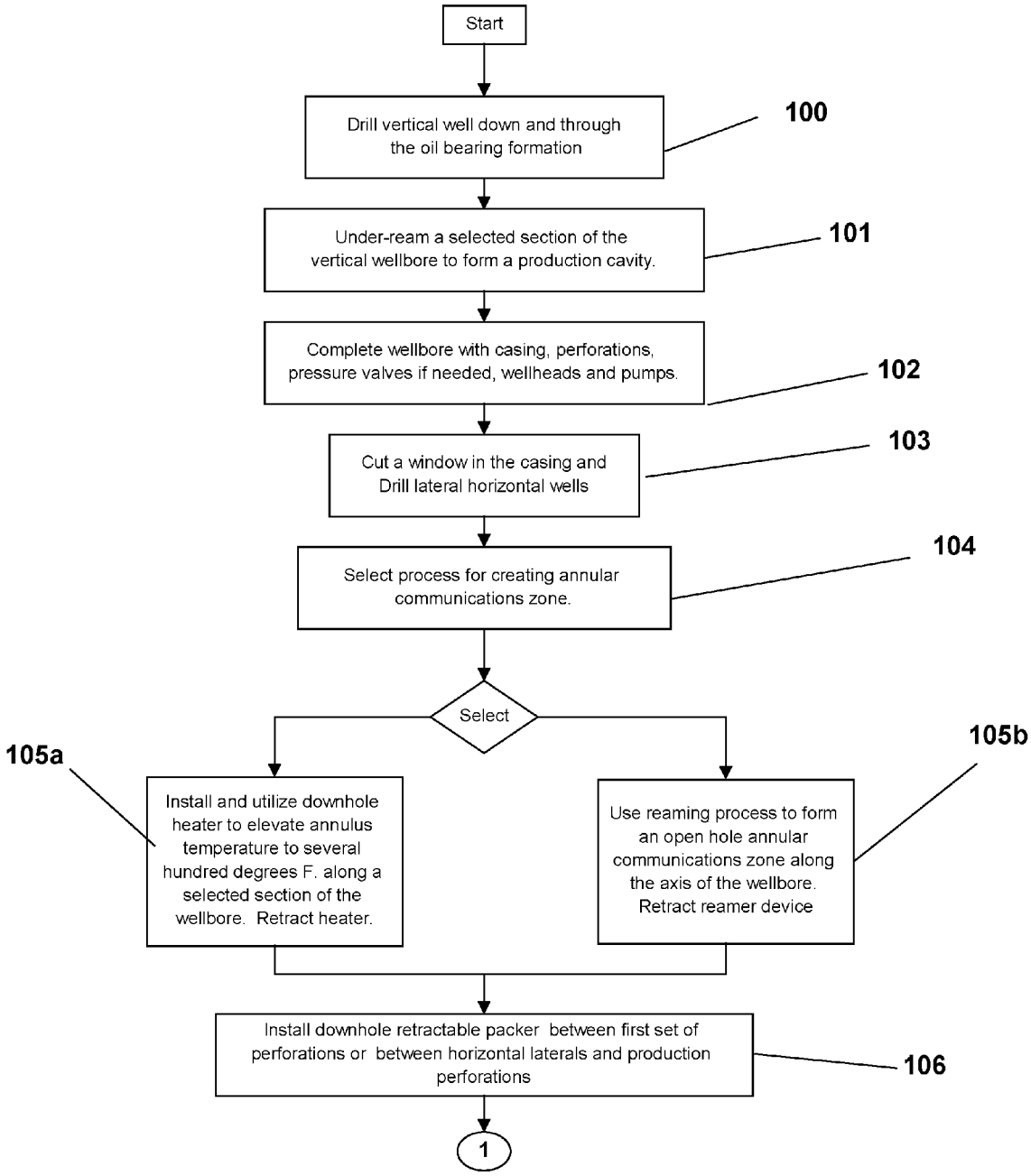
FIG. 10 Shows a block diagram of the operational aspects of the invention.
Figure 11:
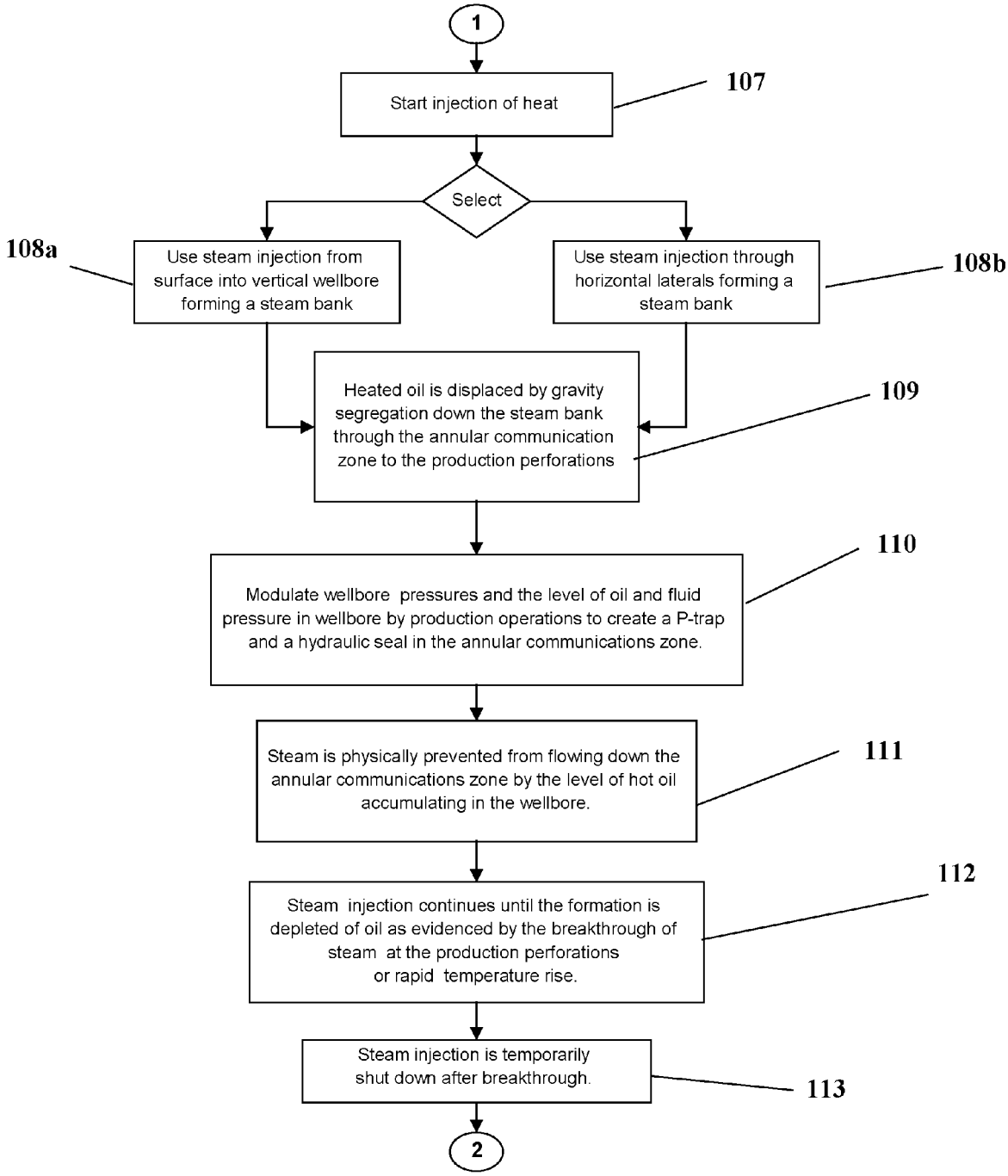
FIG. 11 Shows a block diagram continuing the operational aspects of the invention.
Figure 12:
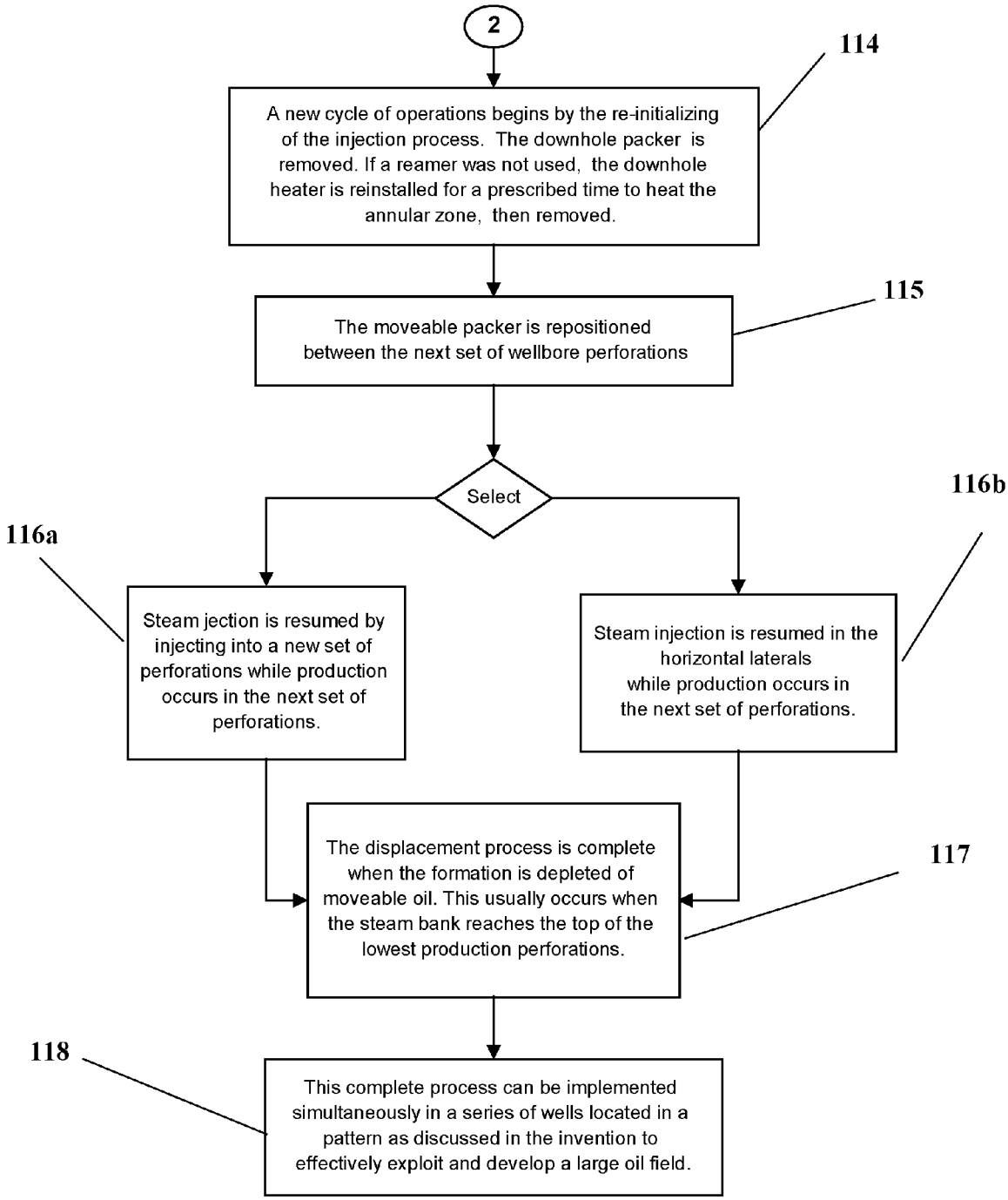
FIG. 12 Shows a block diagram continuing the operational aspects of the invention.

Referring now to the drawings the new method is described as follows. Referring to FIG. 1 and FIG. 10, a central wellbore 2 is drilled from the surface of the ground 1 down to and passing through the hydrocarbon bearing formation 5 as shown in step 100. The central wellbore is under-reamed by using a reamer tool to provide a large cavity 3 up to as much as 8 feet in diameter and several feet deep as indicated in step 101. This cavity 3 can be implemented in the oil formation 5 or ideally in the under-burden formation 6 or in a both zones at the same time. Standard oilfield tools as provided by Ref. 2 are capable of performing this operation routinely. After the central well 2 is drilled and under-reamed to form a production cavity 3 as shown in step 101, the central wellbore 2 is completed and cemented in the formation 5 with steel casing 15 and perforations 16 and 17 made at pre-selected intervals is the wellbore as indicated in step 102. In other embodiments an "open-hole" completion can be used in which there is no steel casing 15 in the wellbore. This can be done in well consolidated rock formations.

Figure 2:
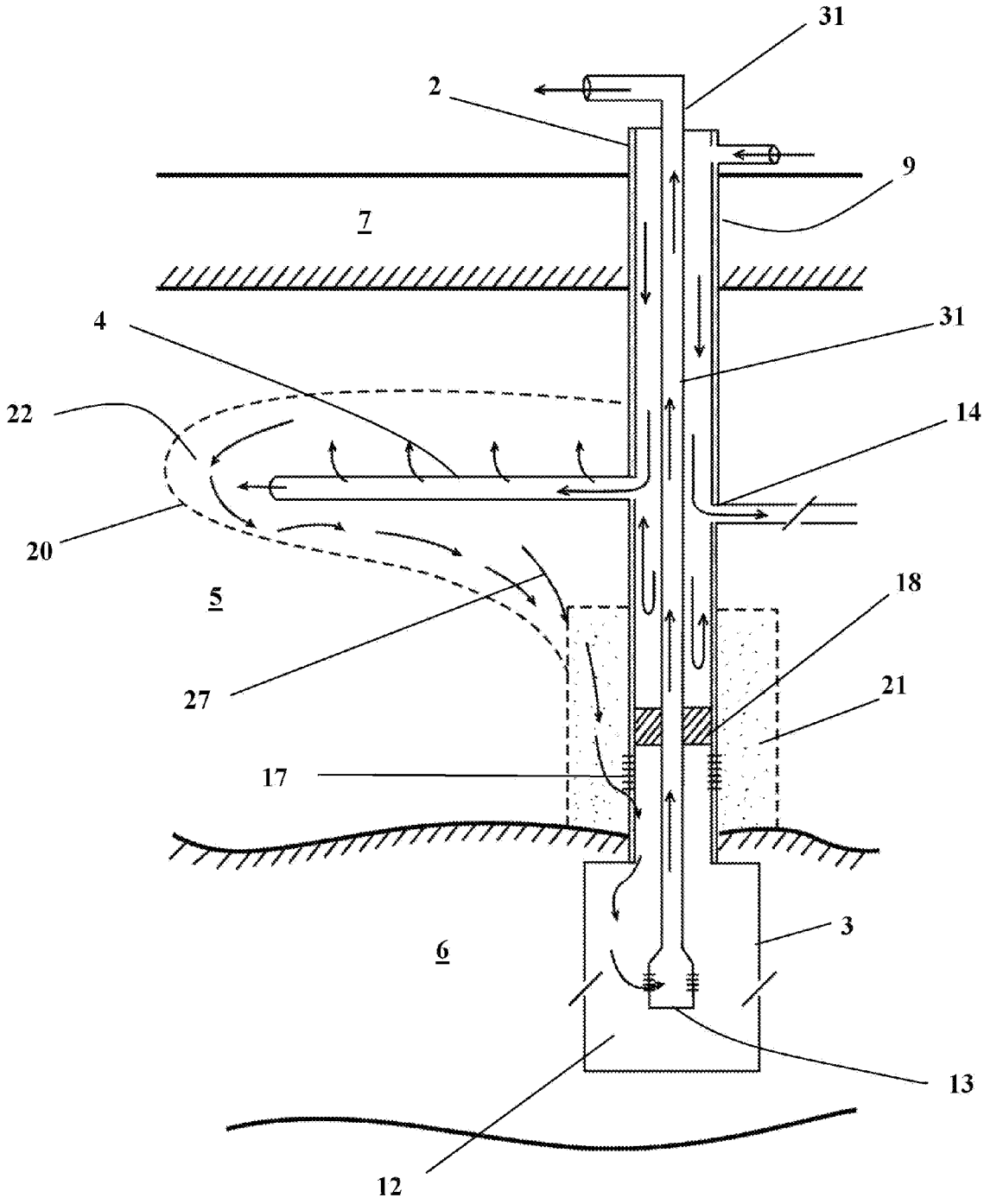
FIG. 2 Shows a cross-section with a horizontal wellbore embodiment, the removable packer, the vertical communication zone, the collection cavity and the production perforations.

In another embodiment a plurality of horizontal laterals 4 shown in step 103, are drilled out from the vertical wellbore 2 by cutting windows 14 and drilling out separate lateral segments as shown in FIG. 2. These lateral wellbores 4 are used for injection of steam 22 into the oil-bearing formation 5 forming a steam bank 20. The steam bank or steam zone 20 is a heated zone in the formation 5 in which the pore spaces of the rock are filled with injected steam 22, condensed hot water and hot oil 12. There may also be some hydrocarbon gas distributed in this zone. Gravity effects cause the steam gas to inhabit the top sections and the oil and water segregate and collect at the bottom of the steam zone 20.

Figure 3:
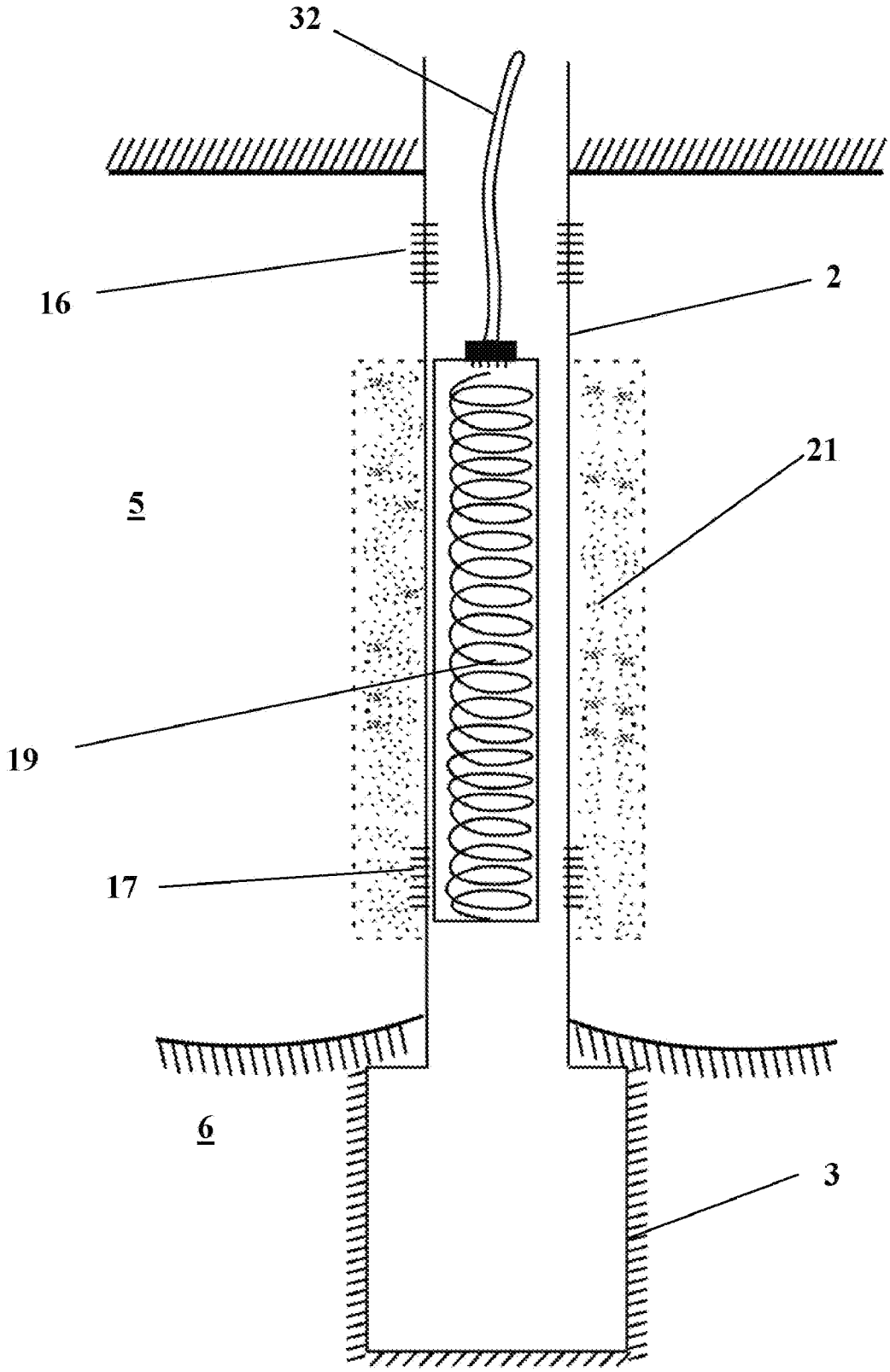
FIG. 3 Shows the implementation of the removable downhole high temperature heater, which heats, up an annular region between the upper and lower perforations which provide a vertical communication zone for the hot displaced fluids.
Figure 4:
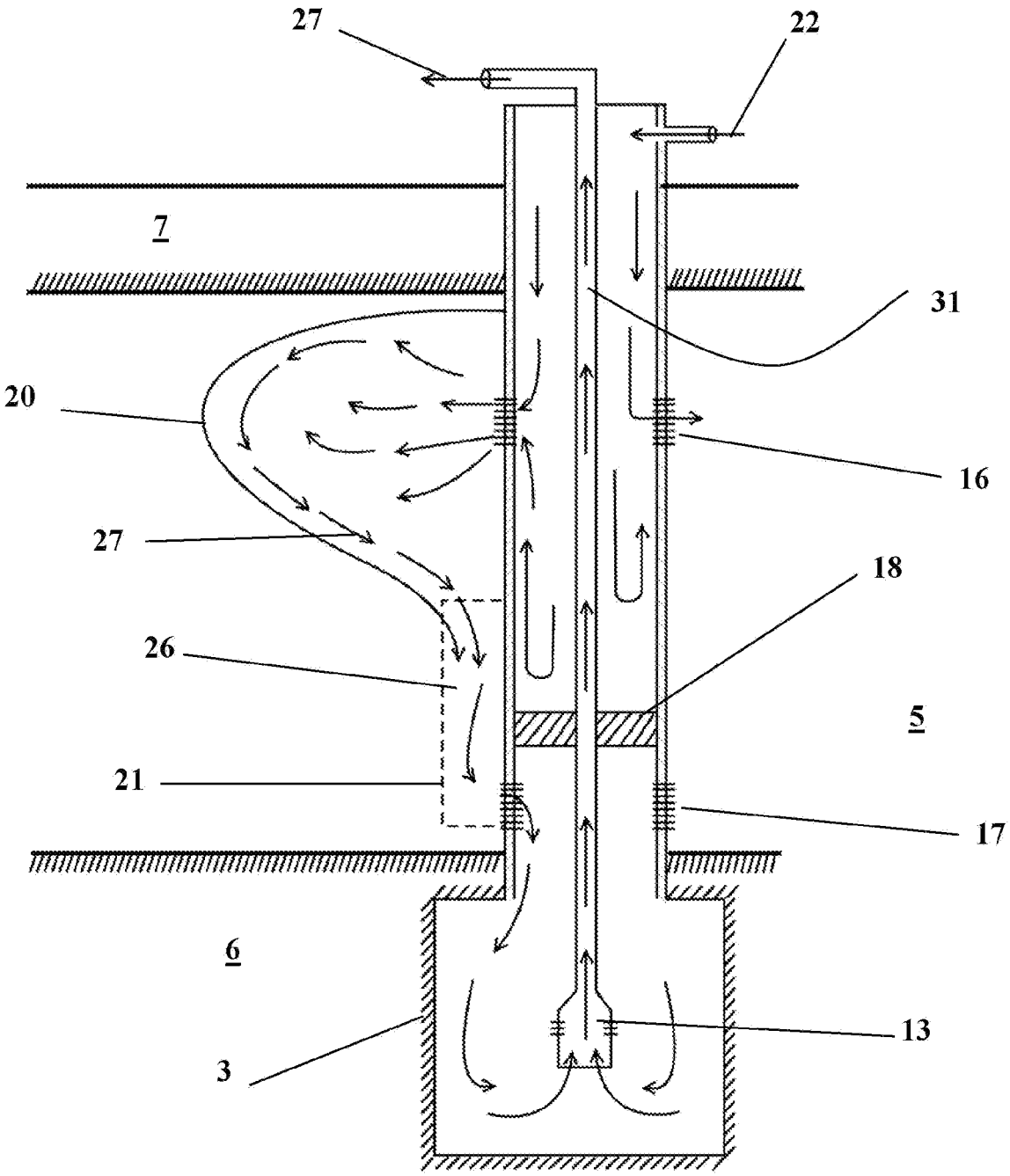
FIG. 4 Shows the flow regimes in which the steam builds an upper chamber because of lower fluid density. The hot mobile displaced oil moves down by gravitational counter-flow along the steam/oil interface and down to the communication zone and finally into the production cavity at the bottom of the vertical wellbore. The oil collects in the lower cavity from which it is pumped to the surface.
Figure 5:
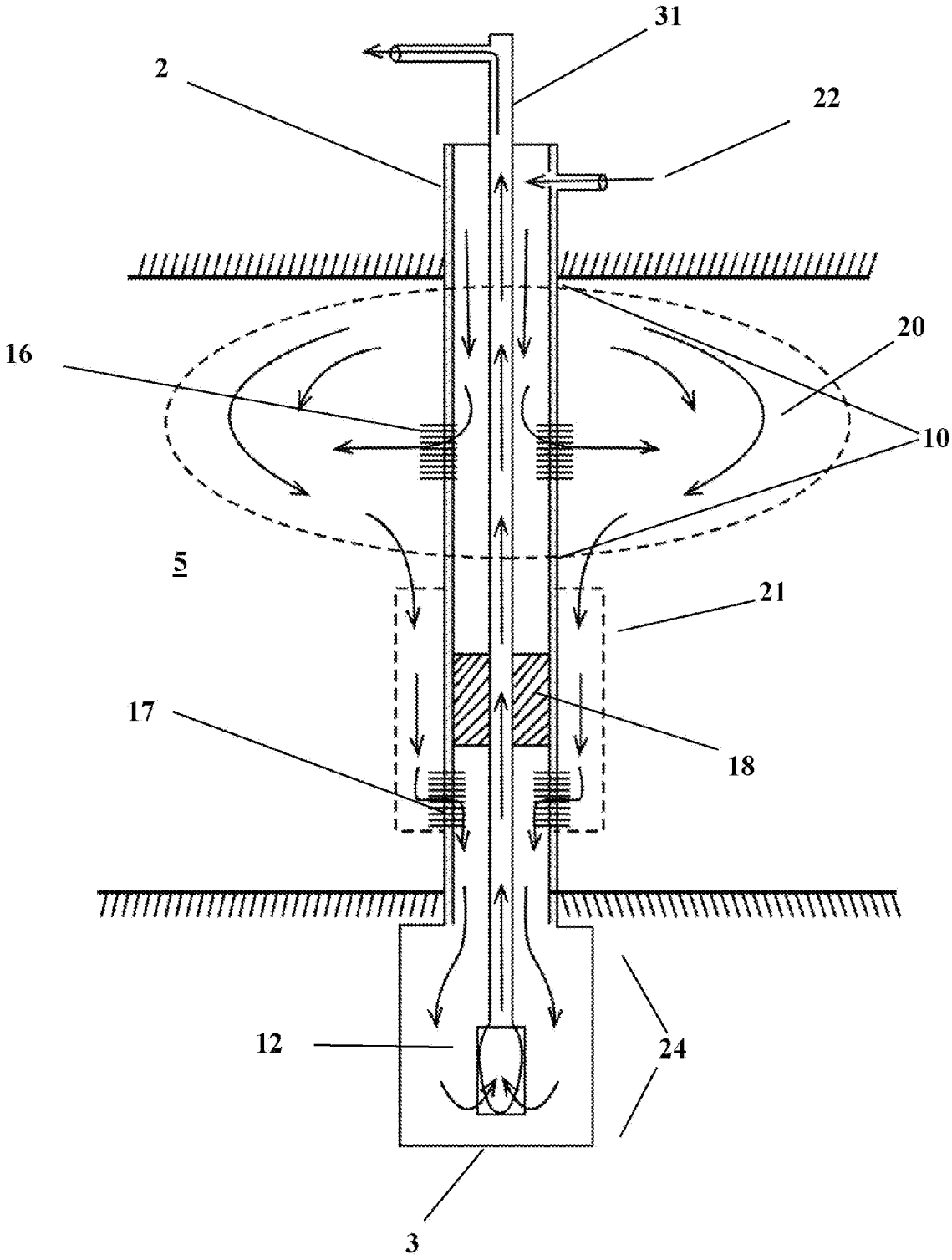
FIG. 5 Shows the three zones of activity involved in the process. The upper injection zone, the central communication and the bottom production zone. There is a major pressure gradient from the high-pressure upper zone down to the lower pressure production zone. The fluid flow follows the pressure gradient in the annular communication zone in the rock formation.
Figure 6:
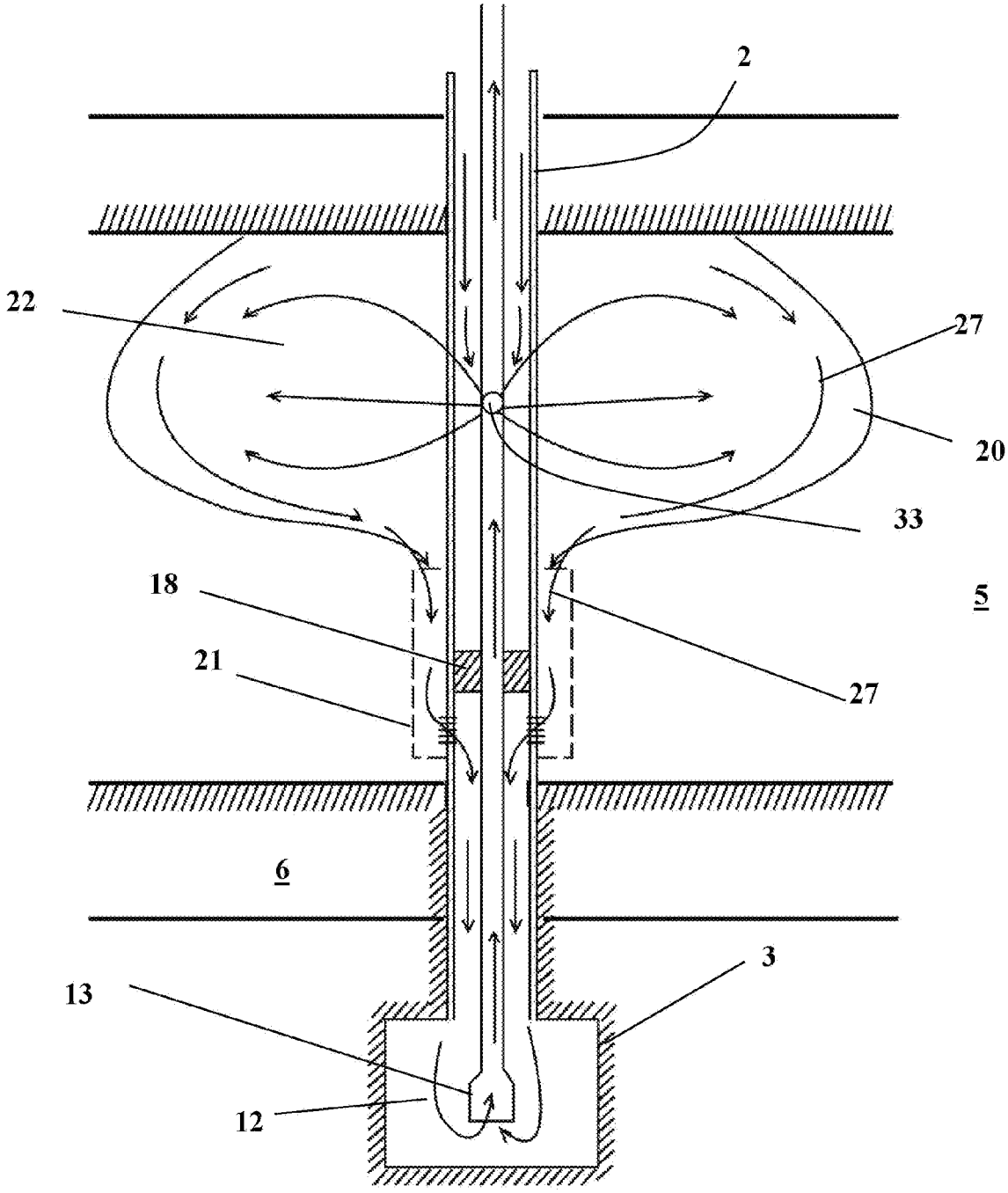
FIG. 6 Shows an end view of FIG. 2 which shows a horizontal wellbore in axial view, drilled into the pay zone. The displacement process and collection of oil in the lower cavity is shown.

As shown in step 104 of FIG. 10, a process is selected to implement the fluid communication zone 21. In one embodiment as shown in step 105*a*, a downhole heater 19 with an electrical power cord 32 is installed as shown in FIG. 3. The heater 19 is initiated and left in place for a predetermined time to heat up the casing 15 and adjacent formation 5 to a temperature high enough to lower the oil viscosity, modify the rock permeability and change the fluid saturations. A temperature between 200 deg. C. and 700 deg. C. is maintained in the formation 5 to achieve these changes. The rock is modified thermally and a concentric radial zone 21 is developed in the formation surrounding the central wellbore 2. Other types of heaters like gas-fired devices can be used without changing the hydrocarbon recovery process.

Further referring to FIG. 1, a production system is implemented by installing a production string 31 commonly called tubing string, a downhole pump 13 and surface facilities to collect and transfer the produced oil. The production system is operated either continuously or intermittently.

Referring to FIG. 10, as shown in step 106, and referring to FIG. 1, a movable and retractable downhole packer 18 is installed on the production string 31 in the annulus between the production string 31 and the casing 15 at a point below the injection steam bank zone 20 and above the first set of production perforations 17. In an "open hole" completion, this packer 18 can be a retractable inflatable packer in those situations where the well is completed without a casing 15.

The following steps illustrate the implementation of the process:

Step 1 Drill a vertical wellbore 9 down to and through the hydrocarbon pay zone 5 as shown in FIG. 1.

Step 2 As shown in FIG. 1, under-ream a cavity 3 below the productive pay zone 5 sufficient to contain the required amount of displaced oil 12.

Step 3 In an alternative embodiment, as shown in FIG. 2, a plurality of horizontal wellbores 4 are drilled at varying heights into the pay zone 5 from the vertical wellbore 9. These horizontal wells are drilled throughout the pay zone for future utilization as injection points for steam as the cycle of operations is repeated as shown in Step 16 below.

Step 4 Complete the well by making the required injection perforations 16 in the upper section of the wellbore 9 and the production perforations 17 in the lower portion of the pay zone 5 as shown in FIG. 1.

Step 5 In one embodiment install a high temperature downhole heater 19 in the casing at a selected location of the wellbore 2 as shown in FIG. 3.

Step 6 Heat the wellbore 2 and surrounding rock formation 5 for a sufficient time and at a calculated temperature sufficient to create a cylindrical annular hot zone of increased fluid conductivity, which creates a vertical communication 21 between the upper and lower perforation zones in the rock formation.

Step 7 The heater 19 is removed from the wellbore 2.

Figure 8:
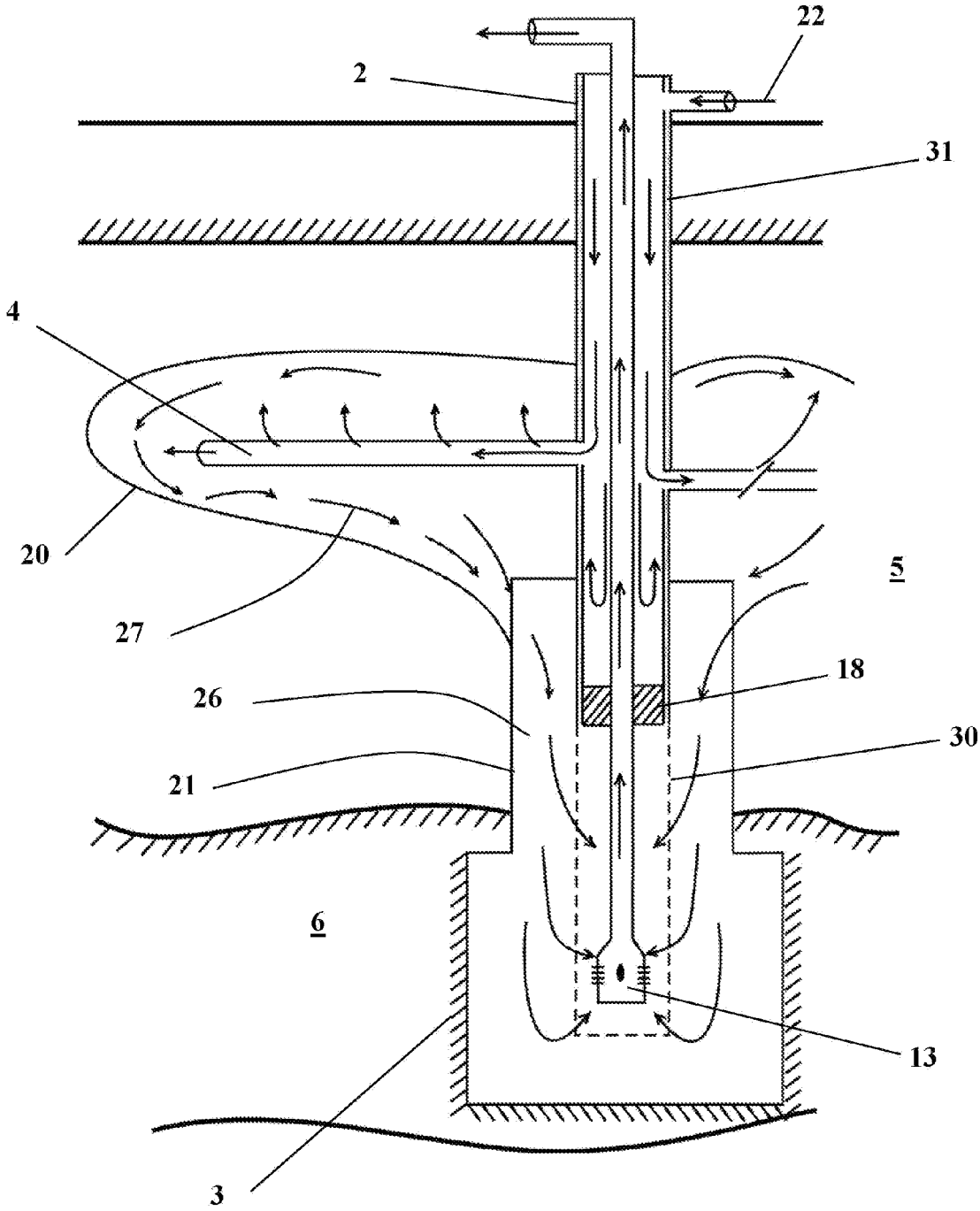
FIG. 8 Shows an embodiment in which a reamed concentric annular region is used as the communication zone.
Figure 9:
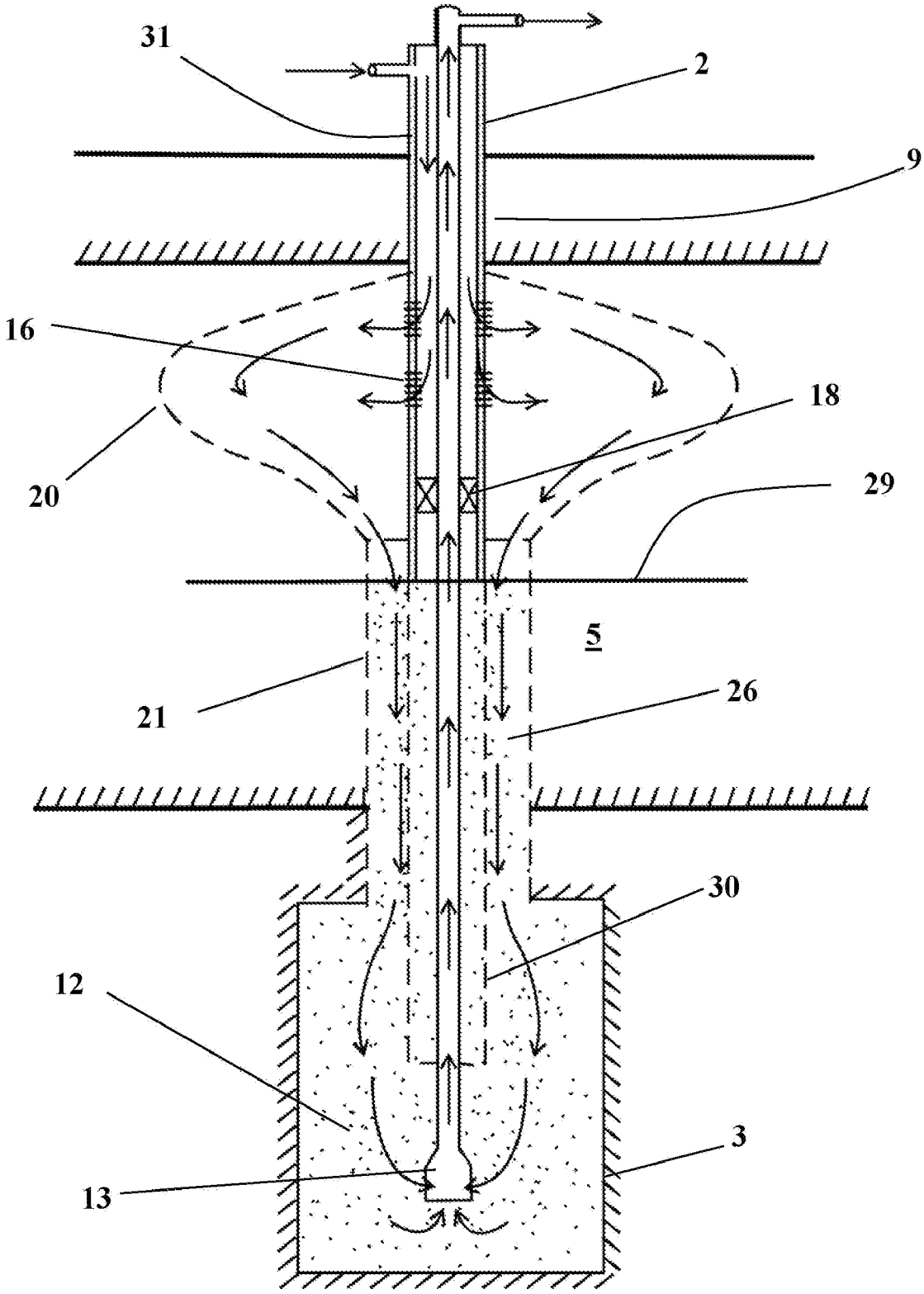
FIG. 9 Shows the embodiment with a reamed concentric annular communication zone in which the control of fluid level by oil production at the surface, allows a "P-trap" hydraulic seal to prevent steam bypass from the steam chamber.

Step 7a In one embodiment, shown in FIG. 8, an annular concentric cavity 26 is reamed out around the central wellbore 2 to form a communications zone from the top of the formation to the bottom. In this embodiment, the heater is not used to modify the near wellbore zone.

Step 8 As shown in FIG. 1 a movable isolation packer 18 is installed in the wellbore 2 between the upper perforations 16 and the lower perforations 17. The isolation packer 18 forces the injected steam 22 to be injected into the pay zone 5. The production tubing 31 is installed through the packer 18 in a conventional manner as used in the oil industry.

Step 9 As shown in FIG. 1, steam 22 is injected into the upper perforations 16. Steam injection can be either continuous or intermittent.

Step 9a In another embodiment, shown in FIG. 2, steam 22 is injected into the horizontal wells 4 which are drilled into the oil formation 5. Steam injection can be either continuous or intermittent.

Step 10 As shown in FIG. 1, steam 22 forms a viable steam chamber 20 in the upper regions of the pay zone 5. The steam is prevented from bypassing downwards into the production zone by the U-tube effect of fluid in the wellbore creating a substantial backpressure and additionally a downhole backpressure valve 34 in the tubing 31 can be used to create this backpressure if needed.

Figure 7:
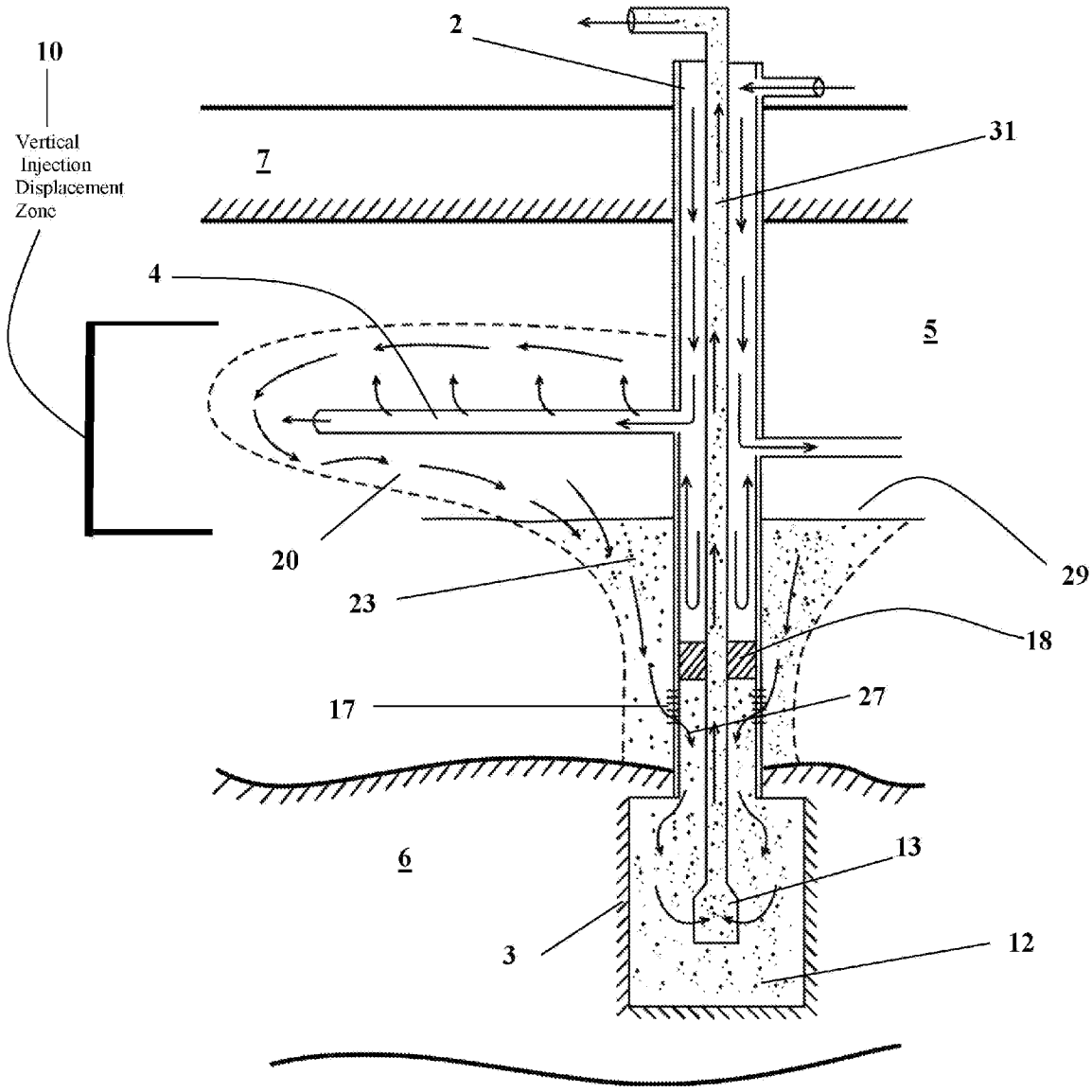
FIG. 7 Shows the "P-trap" effect in which the accumulated oil in the production cavity and communication zone behaves like a hydraulic seal limiting steam bypass.

As shown in FIG. 7 The oil accumulation 12 in the production system can be used as a modulation mechanism by "choking" the surface oil production rate such that a hydraulic seal 23 develops because of the fluid level 29 between light gaseous steam and heavier hot oil. This seal prevents steam bypassing the steam bank 20 and going directly downwards into the collection cavity 3 via the communication zone 21.

Step 11 As shown in FIGS. 6,7,8,9, the heated and mobile low viscosity oil 12 and the condensed steam now as hot water, flow down the interface of the steam chamber 20 along the flow lines 27 and through the communication zone 21 which acts as a high conductivity channel, compared to the almost zero conductivity of the high viscosity portion of the cold pay zone 5. The oil 12 and water accumulate in the collection cavity 3 below the pay zone 5.

Step 12 The conventional downhole production pump 13 lifts the produced oil to the surface through the production tubing 31, which is installed through the isolation packer 18, illustrated in FIG. 1.

Step 13 As shown in FIGS. 5,6,7,8,9 as steam injection continues the steam chamber 20 grows and the displaced oil volume 10 increases.

Step 14 The maximum size of the steam chamber is dictated by the rate of steam injection and the total steam volume injected.

Step 15 The oil zone is depleted when the steam injection completely fills the pay zone and steam 22 production occurs from the production perforations 16. This determined by a sudden rise in temperature and steam gas production through the production perforations Step 16 The steam injection process is re-started. Essentially steps 5 to 15 are repeated. To start, steam injection is curtailed at the surface. The tubing string 31 is pulled from the wellbore, The removable packer 18 is removed, in one embodiment the downhole heater 19 is re-inserted between the next vertically lower pair of perforations and the formation heated to form a new vertical communication zone 21 as shown in step 5 above. In the other embodiment, whereby an annular communication zone 26 was reamed out earlier there is no need for a heater device 19 to set up this communication zone 21. The existing zone is already in place and functioning. The movable packer 18 is moved down the wellbore between the next pair of injection 16 and production perforations 17.

In engineering the steam injection operation, a computer program or simulation analysis is routinely used in the petroleum industry to calculate the optimal required injection time of steam into the hydrocarbon bearing formation for optimal oil recovery. This analysis incorporates steam flow rate, steam quality, steam pressure, formation rock properties, oil saturation and depth of formation from the surface.

In this invention, during the earliest steam injection time only, the production of hot oil is maintained at zero to allow the oil to accumulate in:

(a) the bottom of the steam bank 20, (b) in the vertical communication zone 21 in one embodiment and 26 in another embodiment, and (c) in the wellbore segment 2.

This accumulated hot oil 12 behaves as a hydraulic seal preventing steam from bypassing the formation and flowing into the wellbore. In alternative embodiments, the backpressure system described herein prevents the production of oil into the wellbore. These no-flow embodiments are essential elements of the invention and by preventing oil flow, they allow a steam bank to grow since the injected steam is forced to enter the formation directly heating the rock and in-situ hydrocarbons.

After the requisite injection time, which is nominally a matter of days, the production of hot oil 12 and condensed water is initiated by permitting the removal of hot fluids from the wellbore via the production system or by lowering the backpressure on the fluid column in the wellbore. After the production of accumulated hot oil 12 is complete as evidenced by the incipient flow of gaseous steam detectable at the surface, the fluid production is shut down and the accumulation of hot oil and condensed water at the bottom of the steam bank resumes. It should be noted that in this invention, except as noted later, steam injection is a continuous operation and the oil production phase is started and stopped at specific operational conditions during this thermal recovery process.

This invention differs significantly from the prior art in its implementation in the field. The ability of the well to be produced very soon after steam injection begins, allows oil revenue to begin almost immediately. Furthermore the volumetric flow rate of oil remains relatively constant while the steam bank is growing and can even increase as cumulative steam injection occurs. This is due to the larger volume of rock being contacted and heated thus lowering the oil viscosity and also by increasing the vertical extent of the steam bank, the gravity effect on the oil flow column is increased, both results contribute to increased oil flow rates.

Figure 13:
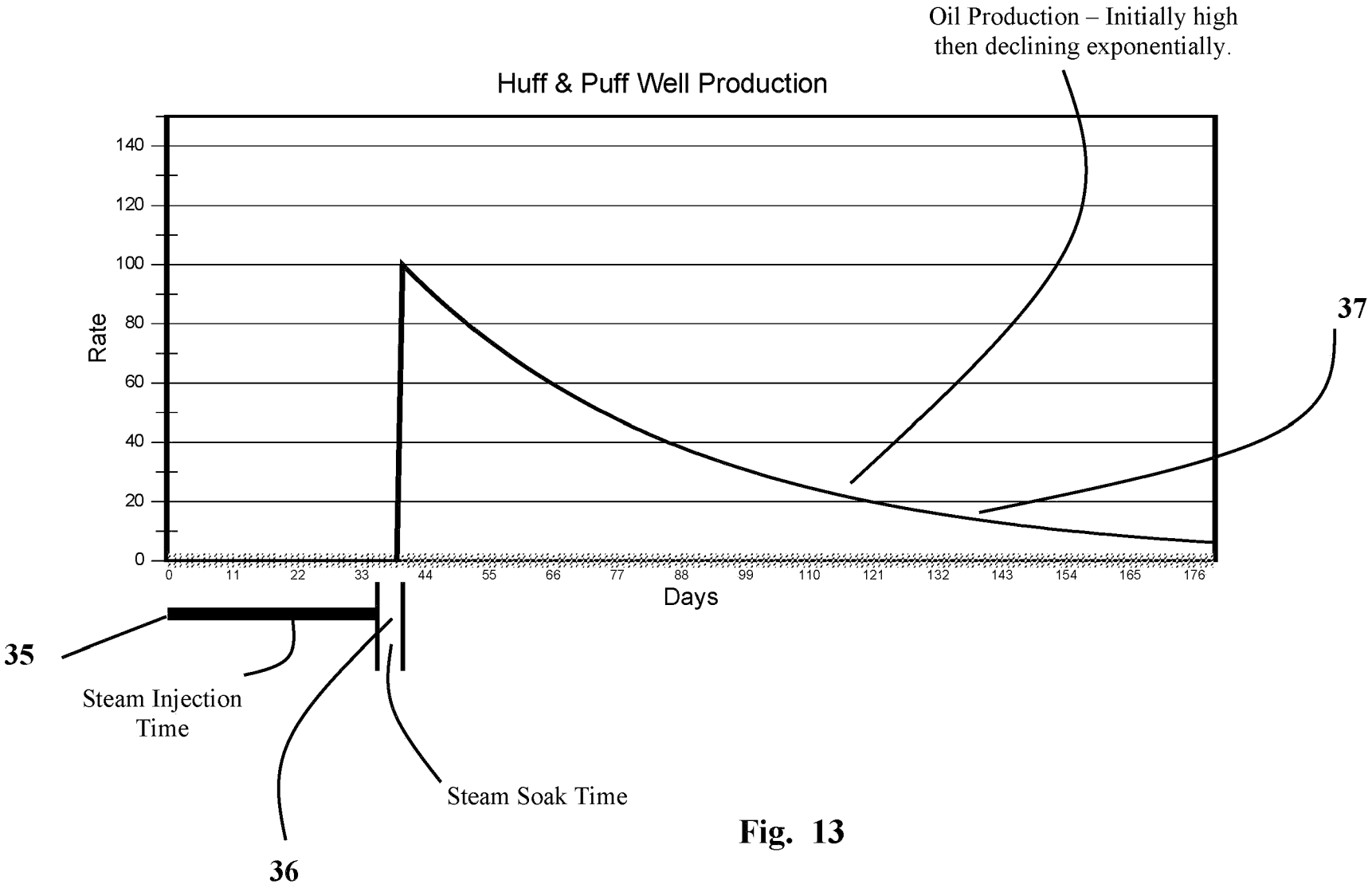
FIG. 13 Shows the graph of production during a typical operation of the prior art in which a "huff and puff" steam field operation is implemented.

A typical response of a steam heated heavy oil reservoir using the prior art of huff and puff thermal operations is shown in FIG. 13. In the huff and puff operations the same wellbore is used for steam injection and after a "soak" period, oil production from the same open perforations in the oil formation zone. The subject invention taught herein, differs significantly from this huff and puff method. It should be noted that after the steam injection time 35, steam injection is curtailed and after the soak time 36, the well is put on production as shown in curve element 37. There is an initial increase in oil production rate which immediately declines exponentially to the un-stimulated level after a number of days. This process is repeated several times to fully develop the steam operations and deplete the oil reservoir.

Figure 14:
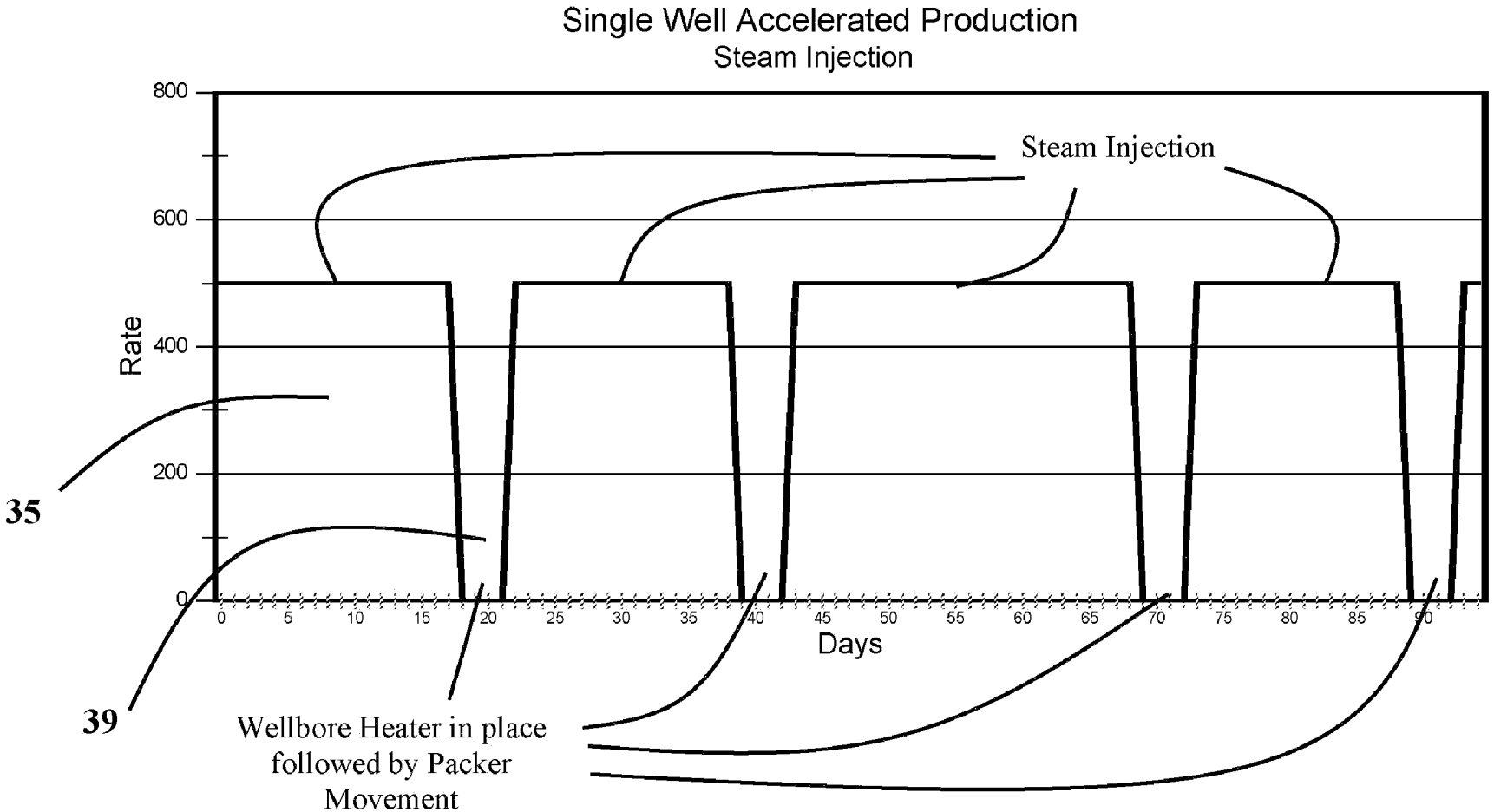
FIG. 14 Shows the graph of the almost continuous steam injection operations implemented in this invention, with the non-injection periods for wellbore annulus heating and moving of retractable packers.

On the other hand, the invention described herein, provides for a very different set of operations. FIG. 14 shows the combined steam injection and oil production period 35 followed by the period 39 in one embodiment in which the wellbore heater 19 is installed in the wellbore and is operated for a fixed time, and during which time the packer 18 is also moved along the wellbore. Note that the steam injection rate is essentially constant, however in practice it is usually necessary to increase the injection rate over time to offset the heat losses as the steam bank increases in size.

Figure 15:
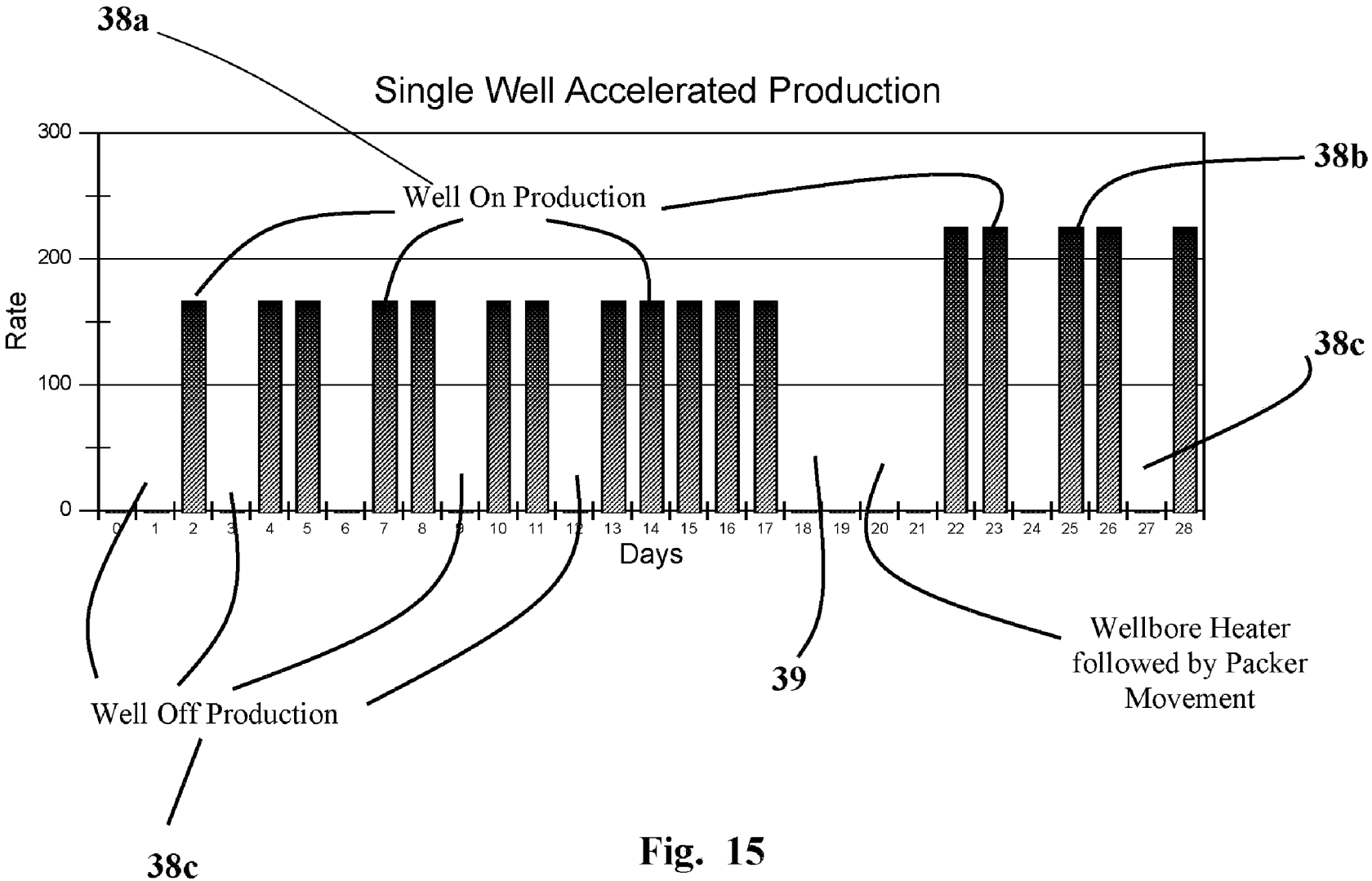
FIG. 15 Shows the on-off oil production graph in a more detailed version of a part of the production cycle early in the life of the field operations.

FIG. 15 shows a more detailed set of operational data where the well production is intermittent. This occurs early in the steam operations since the steam zone or steam bank 20 is still small and growing and the accumulated oil 12 is insufficient to be produced continuously without compromising the hydraulic seal 29 and allowing steam breakthrough in the communication zones 21 and 26 and the wellbore 2. This figure shows the oil production rate 38*a* and the oil shut-in period 38*c*.

Figure 16:
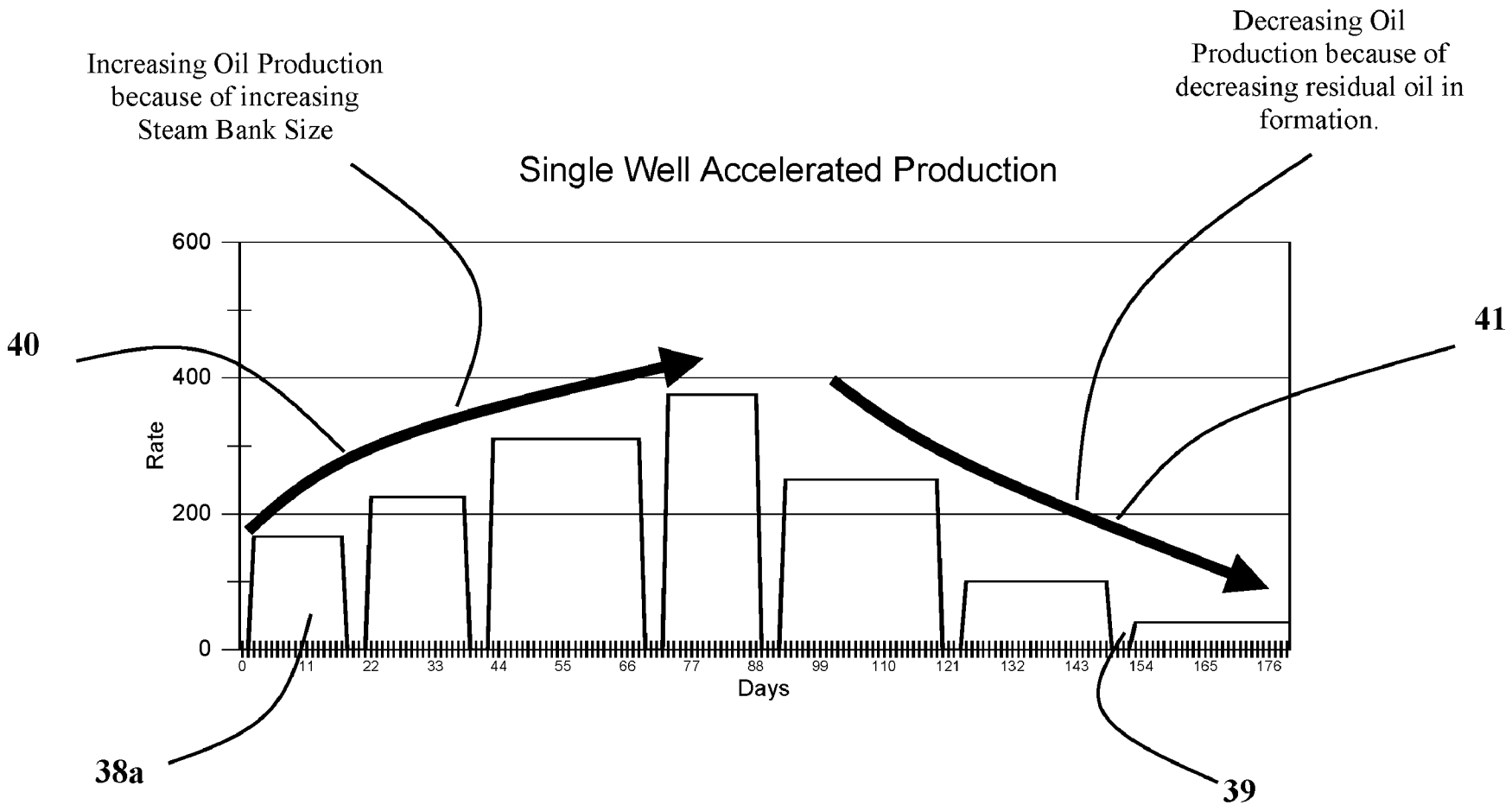
FIG. 16 Shows the graph of the growth trend in oil production rates as the steam injection continues followed by the natural decline accompanying oil reserves depletion.

As the steam bank 20 grows, there is more reservoir formation 5 volume available for oil production and there is a concurrent increase in the oil production rate as shown by the trend line 40 in FIG. 16. This trend continues to a maximum point after which there is an inevitable decline due to heat losses, oil depletion and other factors as shown by trend line 41.

When the oil zone is completely depleted after several operational cycles of moving the injection system downwards between the injection-production pairs of perforations, the steam injection is stopped. This technology provides for a Single Well Accelerated Production (SWAPT™) method of hydrocarbon recovery which is capable of producing oil at rapid rates compare to the current SAGD and TEOR methods of the existing art.

To develop an oil field several wells are drilled and the operations carried out at each well singly or in groups or patterns in a manner described herein.

Given the increased oil flow rates which begin soon after steam injection, coupled with the growth of the steam bank by almost continuous steam injection, as opposed to the intermittent injection of the prior art huff and puff method; and the concurrent oil production increase, this invention provides for an improvement in the technology and prior art in a manner which allows significant rapid development of hydrocarbon reserves from heavy and viscous oil from subterranean formations with existing equipment and field operations applied in a manner that has been heretofore lacking.

In this patent certain U.S. patents, patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the claims.

REFERENCES

1. The Society of Petroleum Engineers 222 Palisades Creek Dr., Richardson, Tex. 75080, U.S.A., www.spe.org.
2. "A Comparison of Mass Rate and Steam Quality Reductions to Optimize Steamflood Performance", Topical Report 108, Gregory L. Messner, July 1998, Stanford University, Stanford, Calif.
3. Harvest Oil Tool Company LLC, 6801 North Peterson Road, Sedalia, Colo. 80135, U.S.A. www.harvesttool.com

I claim:

1. A method for recovering hydrocarbons from a subterranean formation containing viscous oil, oil shale, tar sands or other heavy hydrocarbons; the method comprising the steps of:

(a) drilling a central wellbore down to the hydrocarbon bearing formation, thereby penetrating the formation and the under-burden zones;

(b) reaming out the said central wellbore selectively to form a large production cavity located below the hydrocarbon bearing formation;

(c) providing a plurality of perforations in the central vertical wellbore at pre-selected intervals in the upper and lower portion of the said formation;

(d) installing a downhole wellbore packer between upper and lower perforations;

(e) installing production tubing through the said packer;

(f) installing a downhole production pump through the said packer to lift the produced oil to the surface through the said production tubing to lift the produced fluids and displaced fluids to the surface;

(h) injecting a fluid in the central wellbore and heating the central wellbore and surrounding formation for sufficient time and at a calculated temperature so that the resultant steam flows through upper injection perforations to form an annular hot zone of increased fluid conductivity, so as to create a vertical flow of heated low viscosity oil and hot water produced from condensed steam, towards lower production perforations;

(i) collecting hot oil and water in the said production cavity;

(j) lifting the produced oil to the surface by using the said downhole production pump.

2. The method of claim 1, further comprising the steps of: drilling a plurality of lateral wellbores from the central vertical wellbore into the said formation to serve as additional injection points.

3. The method of claim 2, wherein the downhole packer forces the injection fluid to exit the lateral horizontal wellbores and be injected into the hydrocarbon bearing formation.

4. The method of claim 2, wherein the plurality of lateral wellbores is implemented essentially in a horizontal mode.

5. The method of claim 1, further comprising the steps of: cementing the central wellbore in the said formation by steel casing.

6. The method of claim 5, further comprising the steps of: installing a downhole heater with an electrical power cord, wherein the said heater is initiated and left in place for a predetermined time to heat up the said casing and adjacent formation to a temperature high enough to lower the oil viscosity, modify the rock permeability and change the fluid saturations.

7. The method of claim 6, wherein the said temperature ranges between 200 deg. C. and 700 deg. C.

8. The method of claim 6, wherein the downhole heater provides a high temperature source which conductively transmits the heat to the annular near-wellbore region.

9. The method of claim 1, further comprising the steps of: reaming out an annular concentric cavity around the central wellbore to provide a conduit for fluid flow from the steam injection zone to the oil production zone.

10. The method of claim 1, wherein the U-tube effect of fluid in the wellbore is used for creating a substantial backpressure to prevent the steam from bypassing downwards into the production cavity.

11. The method of claim 1, further comprising the steps of: installing a downhole backpressure valve in the production tubing to create a backpressure to prevent the injected steam from bypassing downwards into the production cavity.

12. The method of claim 1, wherein the central wellbore extends substantially throughout the heavy oil formation.

13. The method of claim 1, wherein the central wellbore extends substantially below the heavy oil formation.

14. The method of claim 1 wherein the perforation zones in the vertical wellbore are positioned as paired groups or couplets.

15. The method of claim 14, wherein the proximal perforations in the paired group form an injector set of perforations.

16. The method of claim 1, wherein the next or distal set of perforations in the pair group forms a producer set of perforations.

17. The method of claim 1, wherein the downhole packer is retractable, moveable and can be solid or inflatable.

18. The method of claim 1 wherein the injected fluid is steam.

19. The method of claim 1, wherein the injected fluid forms a steam bank or chamber in the hydrocarbon reservoir.

20. The method of claim 1, wherein as the steam grows displacing more hydrocarbon, the downhole packer is moved sequentially downward along the wellbore to form a couplet pair of injection-production perforations such that steam continues to enter the lateral injector wells.

21. The method of claim 1, wherein backpressure in the fluid filled vertical wellbore is maintained by controlling the fluid production rate from the central wellbore cavity.

22. The method of claim 21, wherein the fluid filled vertical wellbore functions as a P-trap effect providing a hydraulic seal to keep the steam injection from bypassing the cold viscous reservoir rock formation and moving directly and vertically into the production zone.

23. The method of claim 22, wherein the P-trap is used for flow control of the produced oil in the wellbore.

24. The method of claim 1, wherein the injected fluid is a combination of steam and heated water.

25. The method of claim 1, wherein the displacing fluid is injected intermittently.

26. The method of claim 1, wherein the displacing fluid is injected continuously.

27. The method of claim 1, wherein the produced fluids are recovered intermittently.

28. The method of claim 1, wherein the produced fluids are recovered continuously.

29. The method of claim 1, wherein the hot annular zone extends substantially from below the base of the injection perforations to the top of the production perforations.

30. The method of claim 1, wherein the vertical steam flow is controlled by maintaining a prescribed fluid level in the central cavity.

31. The method of claim 30, wherein maintaining a prescribed oil level in the wellbore prevents the flow of steam bypassing the cold formation and flowing to the production perforations.

32. The method of claim 1, wherein the said production cavity in the central wellbore extends a finite distance inside the oil formation.

33. The method of claim 1, wherein the reaming out step is carried out to form the said production cavity below the hydrocarbon bearing formation.

34. The method of claim 1, wherein the reaming out step is carried out to form the said production cavity within the hydrocarbon bearing formation.

35. The method of claim 1, wherein the reaming out step is carried out to form the said production cavity at the bottom of the hydrocarbon bearing formation.

36. The method of claim 1, wherein the reaming out step is carried out to form the said production cavity partially within the hydrocarbon bearing formation and partially below the hydrocarbon bearing formation.

* * * * *